US006643480B2

(12) United States Patent
Kuwata et al.

(10) Patent No.: US 6,643,480 B2
(45) Date of Patent: Nov. 4, 2003

(54) IMAGE FORMING APPARATUS WITH DEMOUNTABLE SHEET CONVEYOR UNIT IN MAIN BODY FOR RECEIVING SHEETS FROM OPTIONAL SHEET STACK CONNECTABLE THERETO

(75) Inventors: Takashi Kuwata, Shizuoka (JP); Kiyoharu Yoshioka, Shizuoka (JP); Yasuhiro Uchida, Shizuoka (JP); Makoto Izumi, Shizuoka (JP); Minoru Kawanishi, Shizuoka (JP); Kenichiro Isobe, Shizuoka (JP); Akira Matsushima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/961,327

(22) Filed: Sep. 25, 2001

(65) Prior Publication Data

US 2002/0081124 A1 Jun. 27, 2002

(30) Foreign Application Priority Data

Oct. 2, 2000 (JP) ..... 2000-302680

(51) Int. Cl.[7] ..... G03G 15/00

(52) U.S. Cl. ..... 399/107; 399/13; 399/110; 399/124; 399/388

(58) Field of Search ..... 399/107, 110, 399/124, 388, 13

(56) References Cited

U.S. PATENT DOCUMENTS

| | | | | | |
|---|---|---|---|---|---|
| 5,765,826 | A | | 6/1998 | Isoda et al. | 271/162 |
| 5,802,426 | A | * | 9/1998 | Miyazaki et al. | 399/124 |
| 5,802,427 | A | * | 9/1998 | Sawada et al. | 399/124 |
| 6,125,251 | A | * | 9/2000 | Shiraishi et al. | 399/124 |
| 6,134,404 | A | * | 10/2000 | Iwai et al. | 399/110 |
| 6,215,970 | B1 | * | 4/2001 | Yoshikawa et al. | 399/124 |

* cited by examiner

*Primary Examiner*—Susan S. Y. Lee
(74) *Attorney, Agent, or Firm*—Fitzpatrick, Cella, Harper & Scinto

(57) ABSTRACT

A main body of an image forming apparatus has an image forming section to which a sheet is fed from an optional sheet deck when it is coupled to the main body. The sheet fed from the sheet feeding device is received and then forwarded to the image forming section by a sheet conveyor unit which is demountably provided in the main body of the image forming apparatus and is formed of a frame, a pair of conveying rollers within the frame, and a guide.

19 Claims, 18 Drawing Sheets

IMAGE FORMING APPARATUS WITH DEMOUNTABLE SHEET CONVEYOR UNIT IN MAIN BODY FOR RECEIVING SHEETS FROM OPTIONAL SHEET STACK CONNECTABLE THERETO

BACKGROUND OF THE INVENTION

1. Field of the Invention

The present invention relates to an image forming apparatus such as a printer, a facsimile apparatus, or a copying machine and, more particularly, to an image forming apparatus having a main body to which an optional sheet feeding device is detachably connectable.

2. Description of the Related Art

In recent years, the performance of image forming apparatuses such as printers, facsimile apparatuses and copying machines have been improved to cope with the demand for higher processing speed. This leads to a demand for the use of sheet stack cassettes and ejected sheet trays having greater capacities. Image forming apparatuses capable of bulk handling are designed to allow optional sheet feeding devices of large capacities to be connected thereto upon requests of users.

FIG. 18 shows one such image forming apparatus, by way of example. This image forming apparatus has a main body 101 having an image forming section 102, and a sheet feeding device 131 arranged under the main body 101. During operation of the image forming apparatus, a sheet fed by a sheet conveyor unit 132 provided in the sheet feeding device 131 is received by a sheet conveyor unit 103 provided in the main body 101 of the image forming apparatus, and is conveyed by this unit into an image forming section 102 of the image forming apparatus.

This conventional image forming apparatus requires the conveying unit 103 for conveying the sheet fed from an option sheet feeding device 131 into an image forming section 102. It is necessary that actuating means including a motor and an electromagnetic clutch for actuating the conveying unit 103 be installed in the main body of the image forming apparatus, for conveying the sheet fed from the optional sheet feeding device.

Provision for such a motor or electromagnetic clutch requires that a power supply unit installed in the image forming apparatus has a capacity large enough to accommodate power for activating such motor and clutch. Consequently, the structure of the apparatus main body is complicated and the cost of production of the same is raised. Such additional costs, however, does not offer any particular advantage to the users who do not use optional sheet feeding devices.

SUMMARY OF THE INVENTION

Accordingly, it is an object of the present invention to provide an image forming apparatus which is improved to simplify the structure and which can reduce the production cost, while allowing connection thereto of an optional sheet feeding devices.

To this end, according to the present invention, there is provided an image forming apparatus which has: a main body with an image forming section, an optional sheet supply means connectable to the main body, for feeding sheets into the main body, and a sheet conveyor unit demountably mounted in the main body, for receiving, when the sheet supply means is connected to the main body, a sheet fed from the sheet supply means and for conveying the sheet toward the image forming section.

In accordance with yet another object of the present invention there is provided the above-described image forming apparatus, together with a driving power source in the sheet supply means and a driving power transmission means for transmitting driving power from the driving power source in the sheet supply means to the sheet conveying unit mounted in the main body.

In accordance with yet another object of the present invention there is provided an image forming apparatus which has a main body with an image forming section, an optional sheet supply means connectable to the main body, for feeding sheets into the main body, and a sheet conveyor unit demountably mounted in the main body, for receiving, when the sheet supply means is connected to the main body, a sheet fed from the sheet supply means and for conveying the sheet toward the image forming section, wherein a driving power source mounted in the main body and a driving power transmission means for transmitting power from the driving power source to the sheet conveyor unit is mounted in the main body.

In accordance with yet another aspect of the present invention there is provided an image forming apparatus as described above, together with a sheet conveyor means provided in the sheet supply means for conveying the sheets from the sheet supply means into the main body and extension driving power transmission means for transmitting the power derived from the driving power source to the sheet conveyor means.

In accordance with still yet another aspect of the present invention there is provided a sheet conveyor unit for guiding a sheet to an image forming section of an image forming apparatus, the sheet being received from an optional sheet supply means connected to the image forming apparatus. The sheet conveyor unit is comprised of a frame mountable in the image forming apparatus, the frame, when mounted, providing a vertical conveyor path along which the sheet received from the optional sheet supply means is fed upward, a conveyor means provided on the frame for conveying the sheet received from the optional sheet deck and a guide provided on the frame, also for guiding the sheet received from the optional sheet supply means.

Further objects, features and advantages of the present invention will become apparent from the following description of the preferred embodiments with reference to the attached drawings.

DESCRIPTION OF THE PREFERRED EMBODIMENTS

Embodiments of the present invention will now be described with reference to the accompanying drawings.

Figure 1:
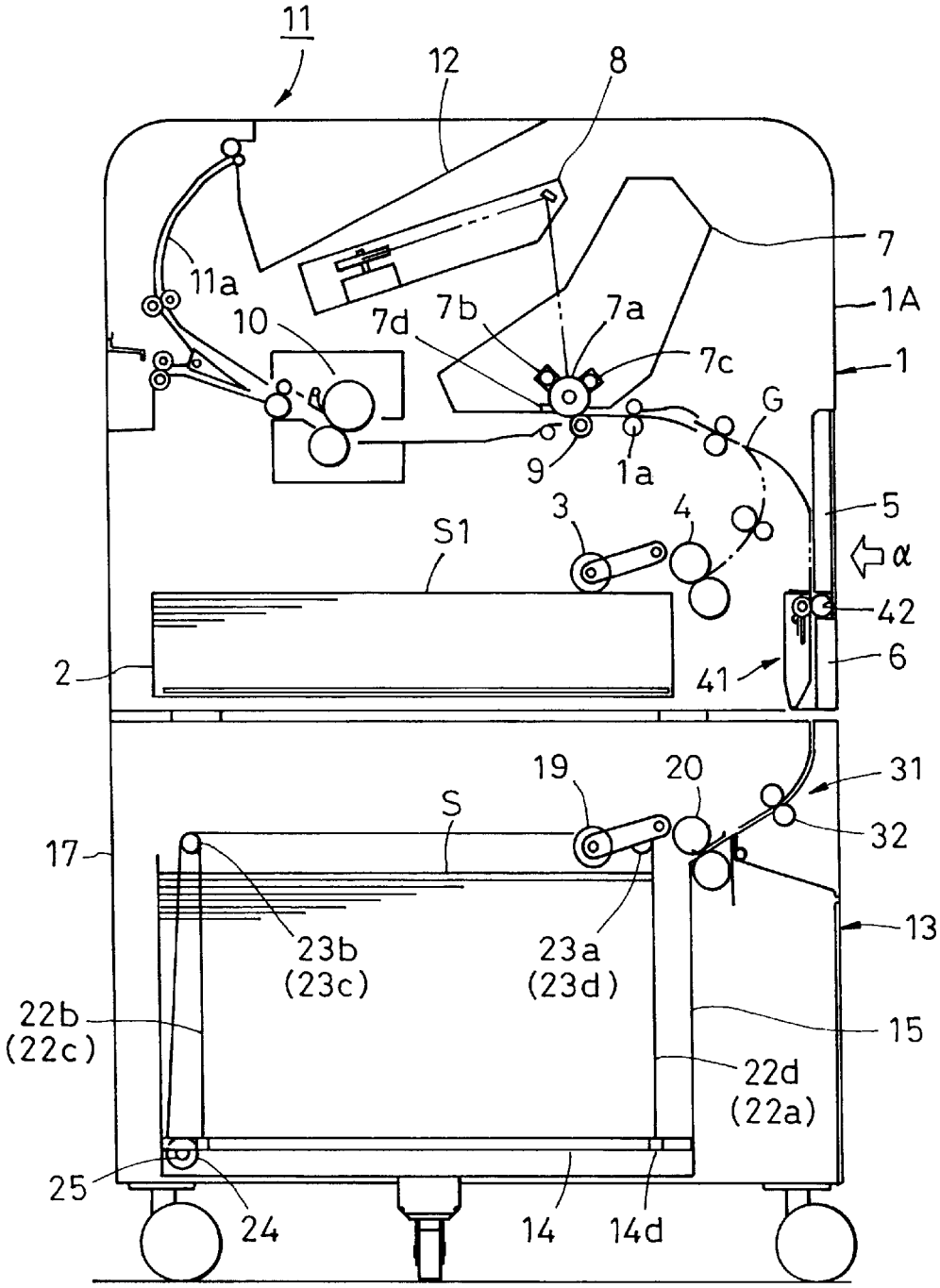
FIG. 1 is a schematic side elevational sectional view of an image forming apparatus of the present invention, showing major parts of the internal structure of the image forming apparatus.

FIG. 1 shows the configuration of an image forming apparatus as a first embodiment of the present invention. Referring to this Figure, the image forming apparatus of the present invention is implemented as a laser beam printer (referred to as an "LBP", hereinafter). The LBP 1 has a main body 1A to a lower portion of which is attached a detachable sheet cassette 2 carrying a stack of sheets S. A pickup roller 3 is arranged so as to feed the sheet S starting from the uppermost sheet of the stack, while a pair of retard rollers 4, 4 serves to separate the sheets S so as to ensure that the sheets are fed in one-by-one fashion. A register roller 1*a* serves to convey the sheet S to an image forming section of the image forming apparatus, in synchronization with the image forming process.

A process cartridge 7 incorporates known process means that provide the image forming section. The process cartridge is demountably mounted in the main body 1A of the image forming apparatus. By way of example, the process cartridge 7 incorporates a photosensitive drum 7*a* as an image bearer, a charger 7*b* for charging the surface of the photosensitive drum 7*a*, a developing device 7*c* for developing a latent image on the photosensitive drum 7*a* so as to form a visible toner image, a cleaning device 7*d* for removing waste toner remaining on the surface of the photosensitive drum 7*a*, and so forth.

This process cartridge 7 performs an image forming process in the following sequence. The surface of the photosensitive drum 7*a* is uniformly charged by means of the charger 7*b*. A laser exposure device 8 emits a laser beam modulated in accordance with image information. The charged surface of the photosensitive drum 7*a* is exposed to the laser beam, whereby a latent image is formed on the surface of the photosensitive drum 7*a*. The latent image us developed into a visible toner image by means of the developing device 7*c*.

A transfer roller 9 is pressed onto the photosensitive drum 7*a*. The sheet S conveyed to the image forming section is caused to pass through a nip between the photosensitive drum 7*a* and the transfer roller 9. The transfer roller serves to impose a voltage of a polarity reverse to that of the toner image, whereby the toner image is transferred to the sheet S.

Numeral 10 designates a fixing device that applies heat and pressure to the sheet S carrying the toner image transferred thereto, thereby fixing the transferred image to the sheet S. The sheet S carrying the image fixed thereto is then introduced into an inverting path 11*a* and is ejected face down onto a sheet eject tray 12 on the top of the main body 1A of the image forming apparatus by means of a pair of sheet eject rollers 11.

A sheet deck 13 is a sheet supply means which is disposed under the LBP 1. The sheet deck 13 accommodates a stack of sheets S in a volume which is too large to be accommodated by the cassette 2. Thus, the sheet deck 13 can supply a large quantity of sheets S to the LBP 1. The sheet deck 13 also serves as a cabinet which carries the LBP 1.

The sheet deck 13 has a magazine 15 which receives a liftable tray 14. Although not shown, guides are provided on the left and right walls of the magazine 15. The tray 14 is extractable along these guides, so as to allow loading of new stack of sheets S thereon.

The tray 14 is suspended in the magazine 15 by means of wire ropes 22*a*, 22*b*, 22*c* and 22*d* each of which is retained at its one end by a portion of the tray 14 adjacent to each corner of the tray 14. These wire ropes 22*a*, 22*b*, 22*c* and 22*d* extend around pulleys 23*a*, 23*b*, 23*c* and 23*d* rotatably provided on upper portions of the magazine 15 and are connected to a hoisting winch 24 provided under the magazine 15.

The hoisting winch 24 is fixed to a take-up shaft 25 to which is secured a gear (not shown). The arrangement is such that the gear on the take-up shaft 25 is brought into engagement with a gear on a motor (not shown) provided in the sheet deck 13, when the magazine 15 is moved back into the sheet deck 13. Therefore, as the motor is started, the hoisting winch 24 rotates to wind up the wire ropes 22*a*, 22*b*, 22*c* and 22*d* on a hoist drum of the hoisting winch 24, whereby the tray 14 is moved upward.

A sheet face sensor (not shown) is provided above the magazine 15, for detecting the upper face of the uppermost sheet of the stack that is being lifted. Upon detection of the upper face of the uppermost sheet S of the stack on the tray 14 which is moving upward, the sheet face sensor produces a detection signal and, upon receipt of this signal, a controller (not shown) operates to stop the operation of the motor. It is thus possible to maintain the upper face of the stack of the sheets S at a predetermined level.

Above the magazine 15 are disposed a pickup roller 19 for feeding the sheets S starting from the uppermost sheet of the stack, a pair of retard rollers 20, 20 which serve to ensure that the sheets S are separated and fed one by one, and a sheet conveyor unit 31 which is a unit for conveying the sheet into the LBP 1. The conveying unit 31 will be referred to as a "deck sheet conveyor unit".

As the height of the stack decreases due to the supply of the sheets S into the LBP 1 by the operation of the pickup roller 19, retard roller pair 20, 20 and the deck sheet conveyor unit 31, the aforementioned upper face sensor produces a signal upon receipt of which the controller operates to start the motor, thereby lifting the tray 14. It is therefore possible to maintain the uppermost sheet of the stack on the tray 14 at a substantially constant level.

When the magazine 15 is extracted from the sheet deck 13 to enable supplementation of sheets S, the gear of the hoisting winch 24 is disengaged from the gear of the motor. Consequently, the hoisting winch 24 is freed so that the wire ropes 22*a*, 22*b*, 22*c* and 22*d* are unwound from the hoisting winch 24 due to the weight of the sheets S and the weight of the tray 14, whereby the tray 14 is lowered to a position where a user can easily supply an additional stack of sheets S. In order to mitigate any impact which may be applied to the tray 14 reaching the bottom of its stroke, a brake damper (not shown) is provided on the take-up shaft 25.

Thus, the sheet S is fed from the sheet deck 13 into the LBP unit 1 by means of the pickup roller 19, the retard roller pair 20, 20 and the conveyor roller pair 32 of the deck sheet conveyor unit 31. The sheet S thus delivered to the LBP 1 enters a sheet conveyor unit 41 in the LBP 1. This sheet conveyor unit 41 will be referred to as an "LBP sheet conveyor unit". The sheet S is then conveyed by a pair of conveyor rollers 42, 42 of the LBP sheet conveyor unit 41. The path for this sheet downstream of the conveyor rollers 42, 42 merges in the path of the sheet S coming from the cassette 2 of the LBP 2 at a junction G. Thus, the sheet S is introduced into the image forming section past the junction G.

The LBP sheet conveyor unit 41 is detachably secured to the LBP 1 when the sheet deck 13 is connected to the LBP 1. Thus, the LBP sheet conveyor unit 41 may be mounted only when the sheet deck 13 is connected to the LBP 1, so as to enable the supply of the sheets S from the sheet deck 13. Thus, the user is required to mount the LBP sheet conveyor unit 41 only when the user wishes to combine the sheet deck 13 with the LBP 1. In other words, the user need not to mount the LBP sheet conveyor unit 41 when the user does not wish to use a sheet deck 13 as an option component. This eliminates wasteful installation of the LBP sheet convey unit 41, contributing to a simplification of the structure of the LBP 1 and to a reduction in the cost.

Figure 2:
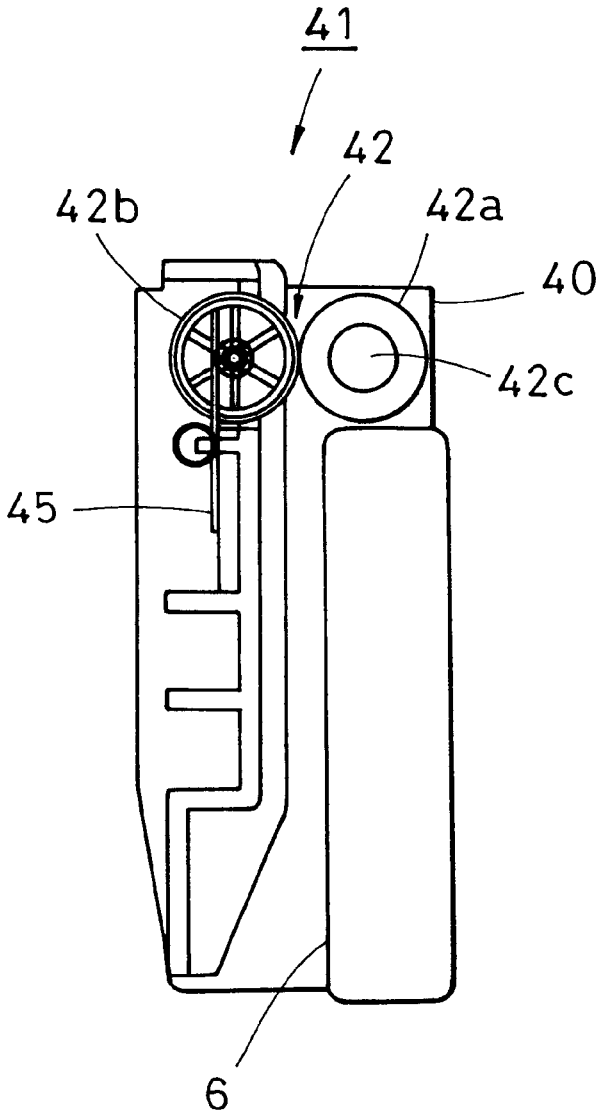
FIG. 2 is an enlarged side elevational view of a sheet conveyor unit provided on an LBP of FIG. 1.

FIG. 2 is a longitudinal sectional view of the LBP sheet conveyor unit 41. The LBP sheet conveyor unit 41 has an internal frame 40 which provides a vertical conveyor path along which the sheets S are fed upward, the pair of conveyor rollers 42 for conveying the sheet S, and a sheet guide 6 for guiding the sheet S. The conveyor roller pair 42 has a power-driven conveyor roller 42*a* and an idler roller 42*b* which is frictionally driven by the sheet S which is being advanced by the power-driven sheet conveyor roller 42*a*. A coiled spring 45 is provided so as to urge the idler roller 42*b* towards the power-driven sheet conveyor roller 42*a*. The LBP sheet conveyor unit is configured to be detachable from the LBP 1.

Figure 3:
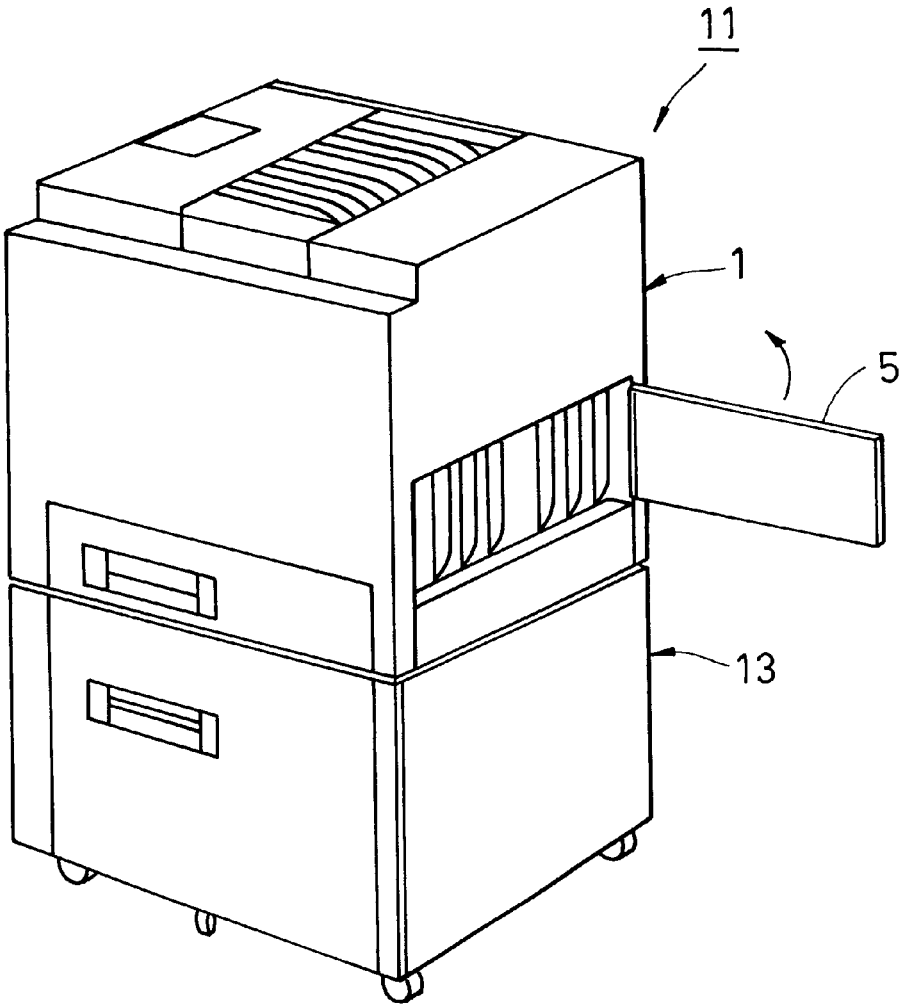
FIG. 3 is a schematic perspective view of the appearance of the image forming apparatus shown in FIG. 1.

FIG. 3 is a schematic perspective view of the image forming apparatus 1. The interior of the LBP 1 becomes accessible to enable mounting of the LBP sheet conveyor unit 41 when a door 5 on a side wall of the LBP 1 is opened. The LBP sheet conveyor unit 41 is then moved into the LBP 1. When the sheet deck 13 is not connected to the LBP 1, the LBP sheet conveyor unit 41 may be separated from the LBP 1. Thus, the user is required to mount the LBP sheet conveyor unit 41 in the LBP 1 only when the user wishes to use the sheet deck 13. This conveniently serves to simplify the structure of the LBP 1 and to reduce its cost.

A description will now be given of the structure of the LBP sheet conveyor unit 41 and the procedure for mounting this unit in the LBP 1.

Figure 4A:
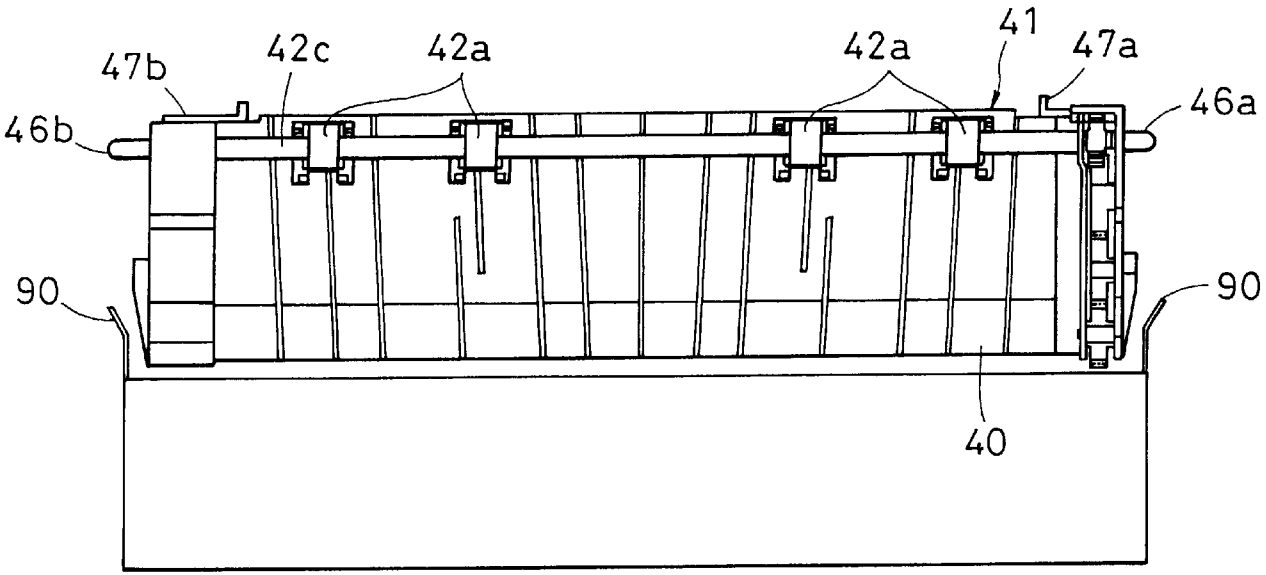
FIGS. 4A and 4B are plan views of the sheet conveyor unit, showing the manner in which the sheet conveyor unit is mounted on the LBP, as viewed from the same side as a door of the LBP.
Figure 4B:
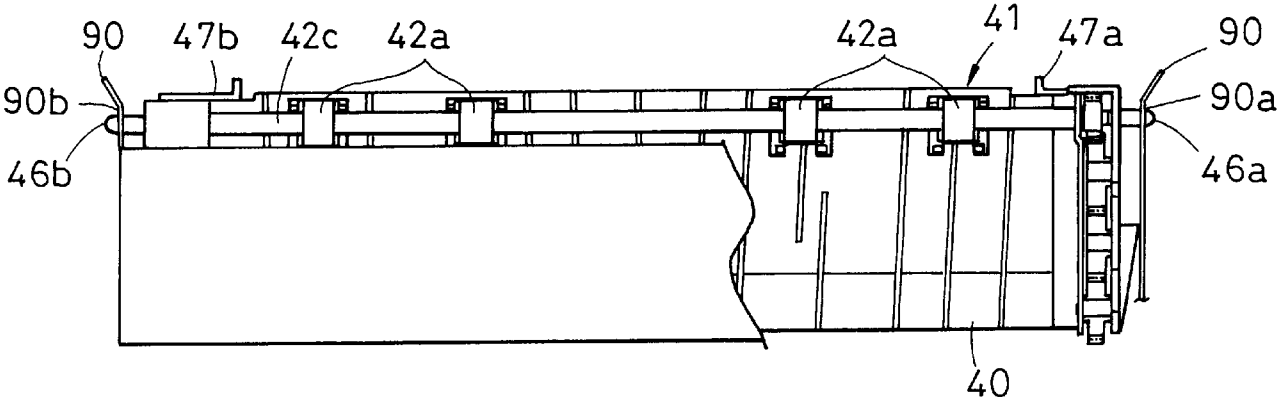

FIGS. 4A and 4B are plan views of the LBP sheet conveyor unit 41 which is being mounted in the LBP 1, as viewed from the same side as the door 5 of the LBP 1, i.e., in the direction of an arrow a in FIG. 1. FIGS. 4A and 4B show, respectively, the LBP sheet conveyor unit in the states before and after the mounting in the LBP 1.

The LBP sheet conveyor unit 41 is provided on both lateral ends thereof with locating shafts 46*a*, 46*b* which are urged outward by means of compressed springs which are not shown. The LBP sheet conveyor unit 41 is inserted downward while the locating shafts 46*a*, 46*b* are caused to slide along metal sheets 90 serving as guides. When the LBP sheet conveyor unit 41 has been moved to a predetermined mounting position, the locating shafts 46*a*, 46*b* are caused to project outward by the compression springs to fit into corresponding locating holes 90*a*, 90*b* which are formed in the metal sheets 90 at predetermined positions, whereby the LBP sheet conveyor unit 41 is located at the correct position. The locating shafts 46*a* and 46*b* are disengageable from the locating holes 90*a*, 90*b* by inward movements of levers 47*a*, 47*b* provided on the top of the LBP sheet conveyor unit 41.

Figure 5A:
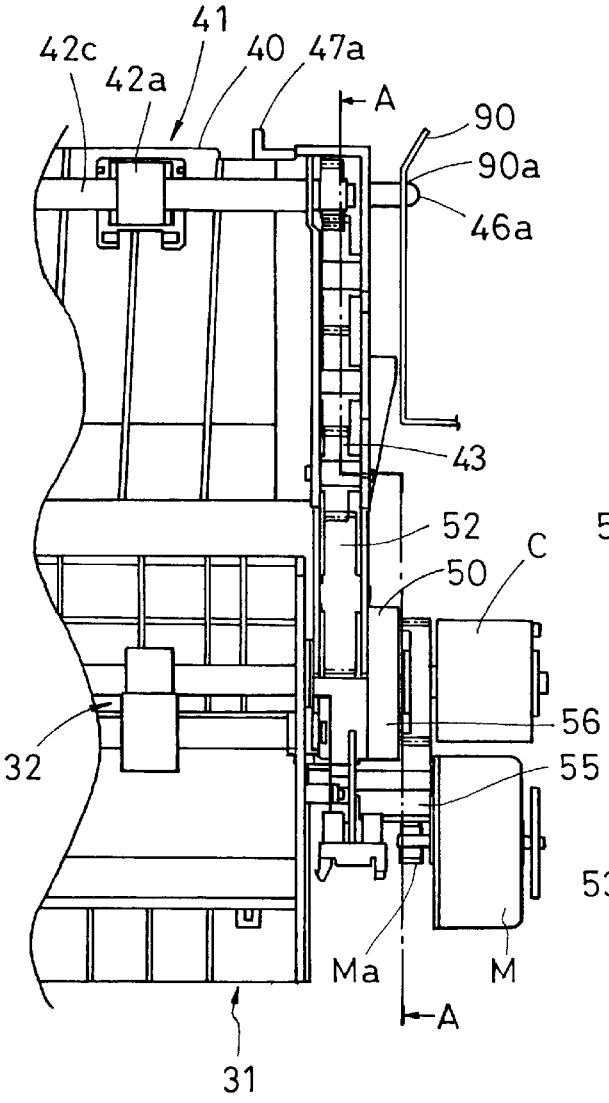
FIGS. 5A and 5B are plan views of the sheet conveyor unit on the LBP and a sheet conveyor unit on a deck, respectively.
Figure 5B:
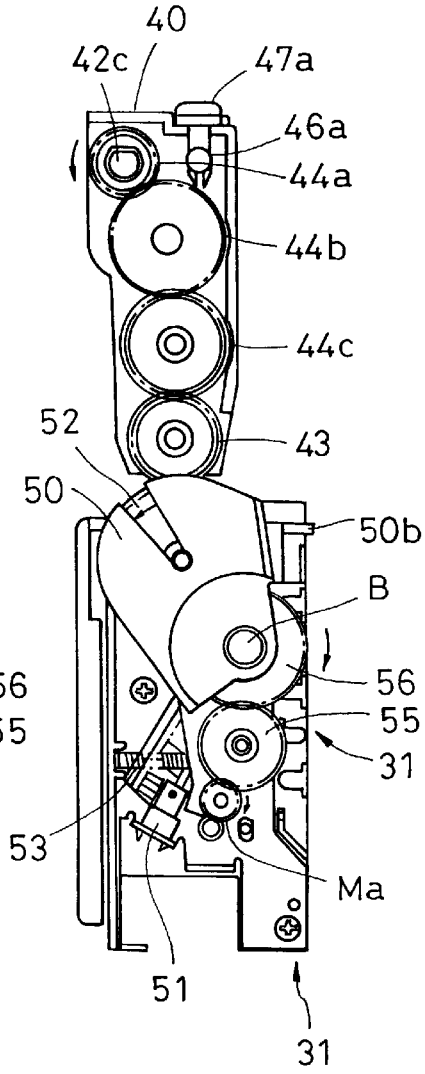

FIGS. 5A and 5B show the LBP sheet conveyor unit 41 and the deck sheet conveyor unit 31, in a state after mounting of the LBP sheet conveyor unit 41 in the LBP 1 and coupling of the deck 13 to the LBP 1. More specifically, FIG. 5A shows these units 31, 41 as viewed in the direction of the arrow α in FIG. 1, while FIG. 5B is a sectional view taken along the line A—A of FIG. 5A.

As will be seen from these Figures, the LBP sheet conveyor unit 41 has the following components or parts: the conveyor roller pair 42 having a power-driven conveyor roller 42*a* and the idler roller 42*b* (see FIG. 2) which is urged by a torsion coiled spring 45 into contact with the conveyor roller 42*a*; a gear train 44*a*, 44*b*, 44*c* and a coupling gear 43 through which driving power is transmitted from the deck sheet conveyor unit 31 to a drive shaft 42*c* of the conveyor roller 42*a* so as to drive the conveyor roller 42*a* in the conveying direction (clockwise); the frame 40 which provide a vertical conveying path along which the sheet S is conveyed upward; the sheet guide 40*b* provided by part of the frame; the locating shafts 46*a*, 46*b* serving as mounting means for mounting the LBP sheet conveyor unit 41 in the LBP 1; compression springs (not shown) for outwardly urging the locating shafts 46*a*, 46*b*; and the levers 47*a* and 47*b*.

The idler roller 42*b* of the conveyor roller pair 42 is adapted to be frictionally driven by the power-driven conveyor roller 42*a* or by the sheet S which is being nipped between these rollers 42*a* and 42*b*.

The gear train 44*a*, 44*b*, 44*c* and the coupling gear 43 in cooperation provide transmitting means for transmitting driving power derived from the sheet deck 13 to the LBP sheet feed unit 41.

A description will now be given of the construction of the deck sheet conveyor unit 31.

The deck sheet conveyor unit 31 has a rocker gear 52 engageable with the coupling gear 43 and provided on a rocker holder 50 which is rotatably carried by a shaft B. The rocker holder 50 is urged clockwise as viewed in FIG. 5B, by means of a tension spring 53. The clockwise rotation of the rocker holder 50 s stopped by a stopper 50*b*.

The deck sheet conveyor unit 31 has a motor M which serves as the driving power source. The arrangement is such that the power of the motor M is transmitted to the rocker gear 52 via a motor gear Ma, a relay gear 55 and a gear 56 provided on the shaft B. The power of the motor M is transmitted also to the conveyor roller pair 32 of the deck sheet conveyor unit 31, via gears which are not shown. The transmission of the power from the motor M to the conveyor roller pairs 32, 42 is controlled by means of an electromagnetic clutch C.

A description will now be given of a detecting means for detecting the state of the LBP sheet conveyor unit 41, more specifically, whether the LBP sheet conveyor unit has been mounted to or demounted from the LBP 1.

The rocker holder 50 is integrally provided at its lower portion with a flag portion 50*a*. A photosensor 51 is provided for cooperation with the flag portion 50*a*. The flag portion 50*a* is selectively sensed by the photosensor 51 depending on whether the LBP sheet conveyor unit 41 has been mounted. It is thus possible to detect whether the LBP sheet conveyor unit 41 has been mounted in the LBP 1.

Figures 6A, 6B, 6C:
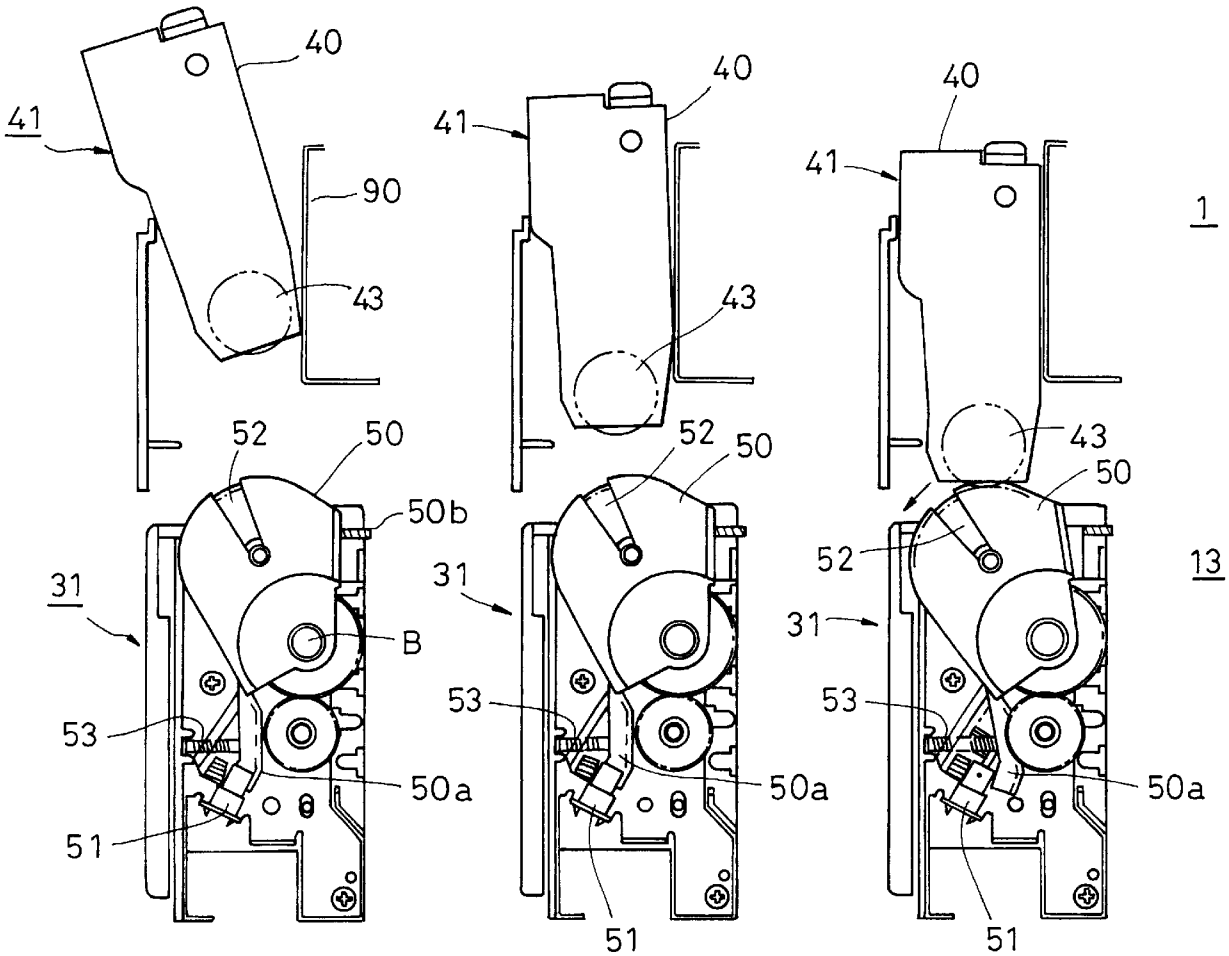
FIGS. 6A to 6C are fragmentary views showing the state of connection between the LBP and the deck, in particular the state of a portion around the path of convey of the sheet.

FIGS. 6A to 6C are fragmentary sectional views of the portion of the image forming apparatus where the LBP 1 and the deck 13 are coupled together, in particular the portion near the path of conveyance of the sheets S as viewed from the rear side (from the back side of the drawing sheet on which FIG. 1 is drawn). These Figures illustrate the procedure of mounting the LBP sheet conveyor unit 41 in accordance with the sequence of the procedure.

Referring to FIGS. 6A and 6B, when the LBP sheet conveyor unit 41 has not yet been inserted into the LBP 1, the rocker holder 50 is held in contact with the stopper 50B. In this state, the flag portion 50*a* interrupts light which otherwise reaches the photosensor 51.

As the LBP sheet conveyor unit 41 is moved into the LBP 1, the lower surface of the frame of the LBP sheet conveyor unit 41 is brought into contact with the top surface of the rocker holder 50 which is provided in the deck sheet conveyor unit 31 and which supports the rocker gear 52, whereby the rocker holder is rotated counterclockwise. As a result, the rocker gear 52 is brought into engagement with the coupling gear 43. Consequently, the flag portion 50*a* of the rocker holder 50 is moved to a position where it does not interrupt the light coming into the photosensor 51, so that the photosensor 51 produces a signal indicating that the LBP sheet conveyor unit 41 has been inserted into the LBP 1.

When the LBP sheet conveyor unit has been mounted, a sheet conveying path is defined between the sheet guide portion of the frame 40 and the sheet guide 6 on the main body 1A of the LBP. At the same time, the rocker gear 52 of the deck sheet conveyor unit 31 is brought into engagement with the coupling gear 43 of the LBP sheet conveyor unit 41, so that power of the motor M, which is the driving power source of the deck sheet conveyor unit, is transmitted through the rocker gear 52 to the conveyor roller 42*a* of the roller pair 42 of the LBP sheet conveyor unit, thereby driving the roller pair 42.

Thus, in the illustrated embodiment, the LBP sheet conveyor unit 41 is detachably mounted in the LBP 1, and the power required for driving the LBP sheet conveyor unit 41 is derived and transmitted from the deck sheet conveyor unit 31. With this arrangement, it is not necessary to mount in the LBP a motor exclusively used for driving the sheet conveyor unit, whereby an inexpensive LBP becomes available for users who do not wish to use the sheet deck 13.

In the event that the user happens to fail to mount the LBP sheet conveyor unit 41 in the main body of the LBP, the detecting means informs the user of the fact that the LBP sheet conveyor unit has not been mounted, thus avoiding the occurrence of troubles such as sheet jam.

A description will now be given of another example of the detection means for detecting the state of the LBP sheet conveyor unit 41, i.e., for determining whether the LBP sheet conveyor unit 41 has been mounted in the main body of the LBP.

Figure 7:
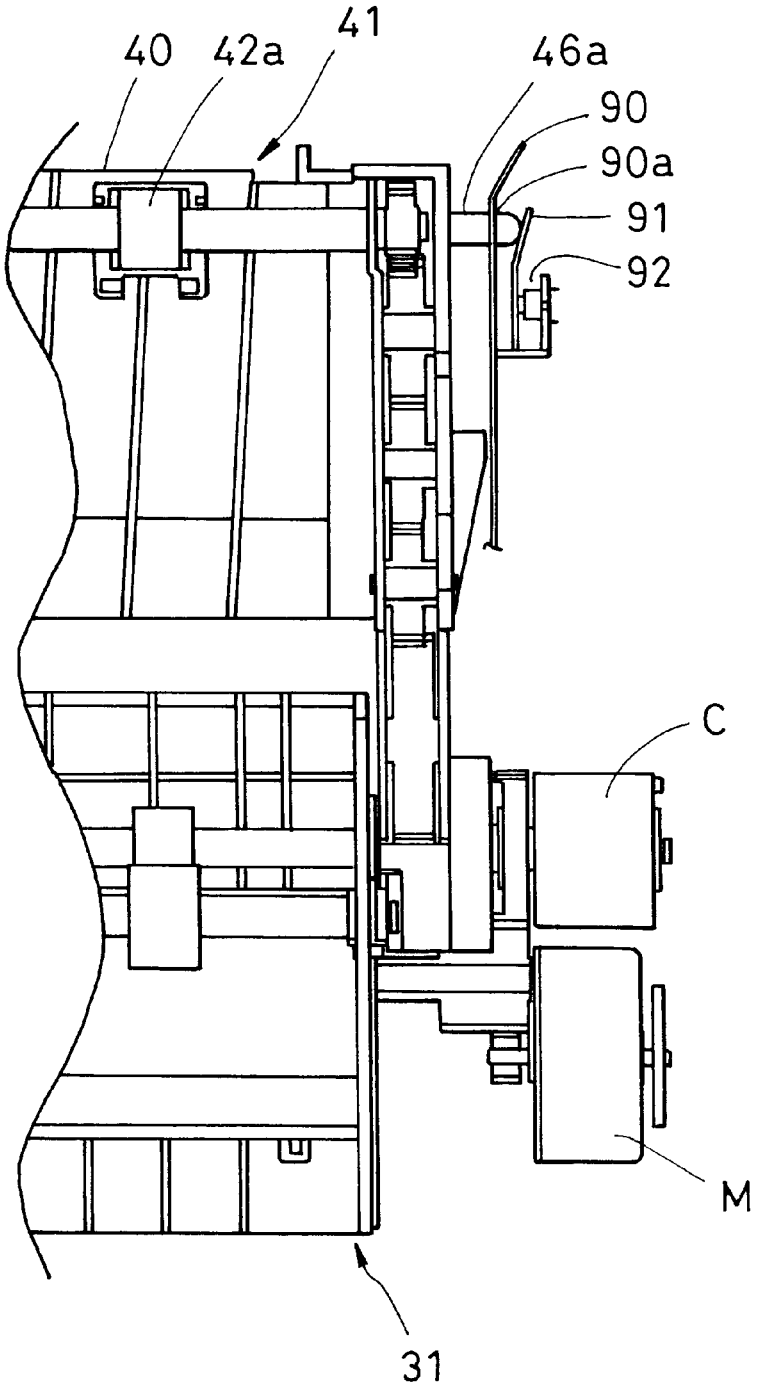
FIG. 7 is an illustration of an alternative of a means for detecting the state of mounting of an LBP sheet conveyor unit.

Referring to FIG. 7, the detecting means including a sensor for detecting the state of the LBP sheet conveyor unit 41 is provided on the LBP 1, in contrast to the preceding example of the detecting means which is installed in the sheet deck.

More specifically, in the arrangement shown in FIG. 7, the deck sheet conveyor unit 31 of the sheet deck 13 is devoid of elements of detecting means such as the photosensor 51, as well as the flag portion 50*a* of the rocker holder 50. In this arrangement, whether the LBP sheet conveyor unit 41 has been mounted in the LBP 1 is detected by a tact switch adapted to be activated by a leaf spring 91 which is positioned in alignment with the locating hole 90*a* formed in one of the side walls of the aforementioned guide in the LBP sheet conveyor unit 41.

When the LBP sheet conveyor unit 41 has been installed in the right position within the LBP 1, the locating shaft 46*a* of the LBP sheet conveyor unit 41 is received in the locating hole 90*a* and is allowed to project outward, as explained before. The locating shaft 46*a* presses the leaf spring 91 which in turn presses the tact switch 92, thereby turning the tact switch on. It is thus possible to detect whether the LBP sheet conveyor unit 41 has been mounted in the LBP.

The detecting means shown in FIG. 7, which is installed in the main body of the LBP, advantageously eliminates the necessity of communication between the controller provided in the sheet deck 13 and the LBP 1 in regard to the state of the LBP sheet conveyor unit 41.

Figure 8:
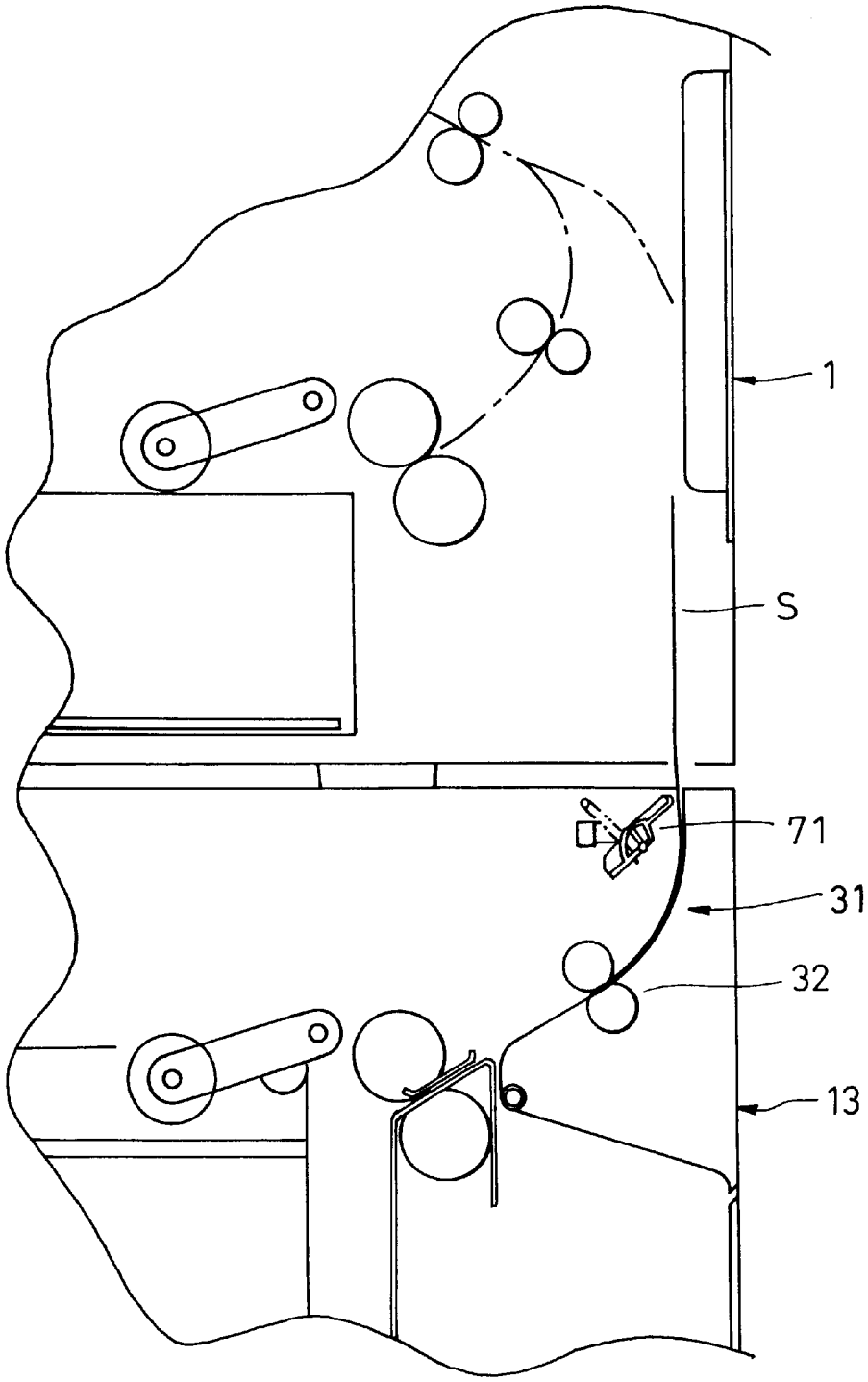
FIG. 8 is an illustration of another alternative of a means for detecting the state of mounting of an LBP sheet conveyor unit.

Still another example of the detecting means for detecting the state of LBP sheet conveyor unit 41 makes use of a jam sensor provided in the deck sheet conveyor unit 31 which is upstream of the roller pair 42 of the LBP sheet conveyor unit 41. FIG. 8 shows the position of the sheet S which has been fed from the sheet deck 13 when the LBP sheet conveyor unit 41 has not been installed in the LBP 1. The sheet S stagnates at a position where the trailing end of this sheet S has left the conveyor roller pair 32 of the deck sheet conveyor unit 31.

In this state, the above-mentioned jam sensor, denoted by 71, is held in an "on" state. If the LBP sheet conveyor unit 41 has been installed in the LBP 1, the sheet S would have been advanced into the main body of the LBP without stagnation so that the jam sensor 71 would have been turned off after passage of the trailing end of the sheet S.

In the illustrated case, however, the sheet S remains at this position, because the LBP sheet conveyor unit 41 and, hence, the conveyor roller pair 42 which would pull the sheet S, so that the jam sensor 71 is kept in the "on" state.

The controller in the sheet deck 13 measures the length of duration over which the jam sensor 71 has been kept "on". If the measured duration exceeds a predetermined length of time, e.g., double the time normally required for the sheet S to pass the jam sensor 71, the controller determines that the LBP sheet conveyor unit 41 has not been installed, and gives a message to the user informing the user that the LBP sheet conveyor unit 41 has not been installed.

It will be seen that the example shown in FIG. 8 can be implemented without incurring any additional cost, because the jam sensor 71 which is already provided for the purpose of detecting a sheet jam is also used as means for detecting whether the LBP sheet conveyor unit 41 has been installed.

Figure 9A:
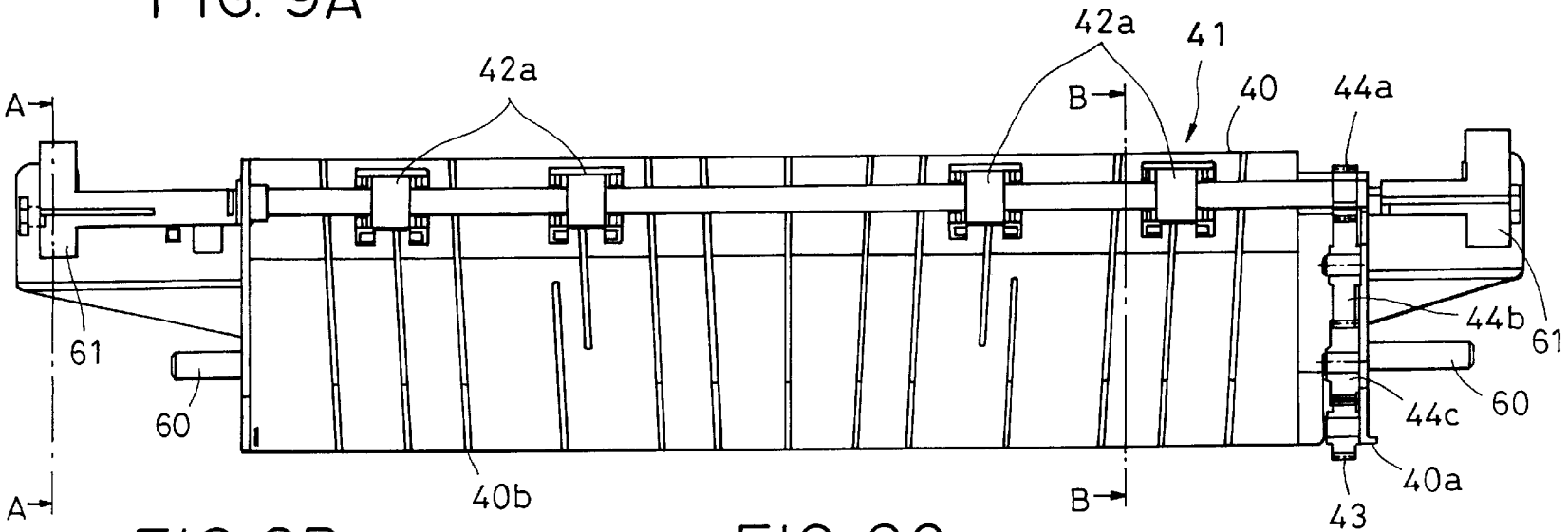
FIGS. 9A to 9C respectively are a front elevational view of another form of the LBP sheet conveyor unit, a sectional view taken along the line A—A of FIG. 9A, and a sectional view taken along the line B—B of FIG. 9A.
Figure 9C:
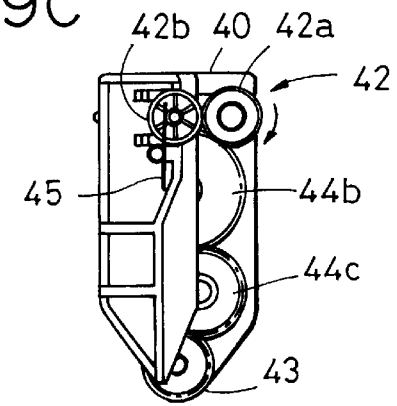
Figure 9B:
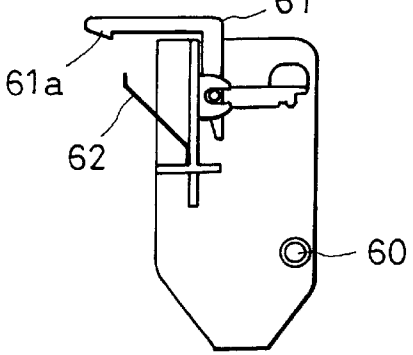

A description will now be given of another example of the LBP sheet conveyor unit 41, with reference to FIGS. 9A to 9C. This example differs from the example described before only in that it employs mounting means different from that used in the preceding example. Other portions of this example of the LBP sheet conveyor unit 41 are therefore not described in detail. This example has mounting shafts 60 serving as mounting means for mounting the LBP sheet conveyor unit 41 on LBP 1, a lever 61, and a leaf spring 62. Numeral 40*a* denotes a locating member which is provided on the lower end of the frame 40 and which serves to locate LBP 1 when the latter is mounted on the sheet deck 13.

Figure 10A:
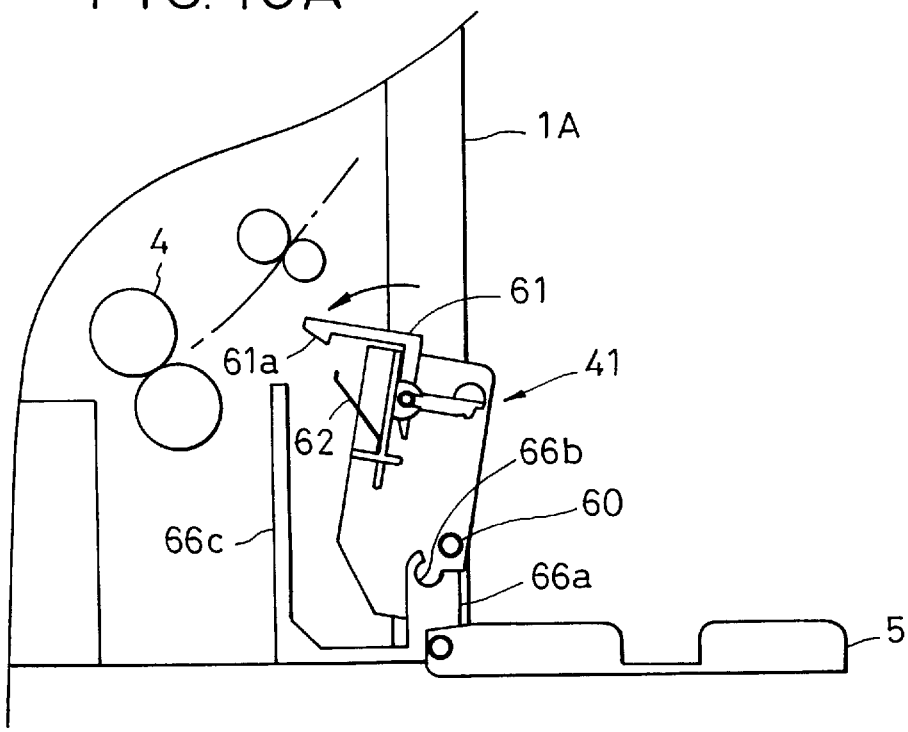
FIGS. 10A and 10B are illustrations of a procedure for mounting the LBP sheet conveyor unit shown in FIGS. 9A to 9C.
Figure 10B:
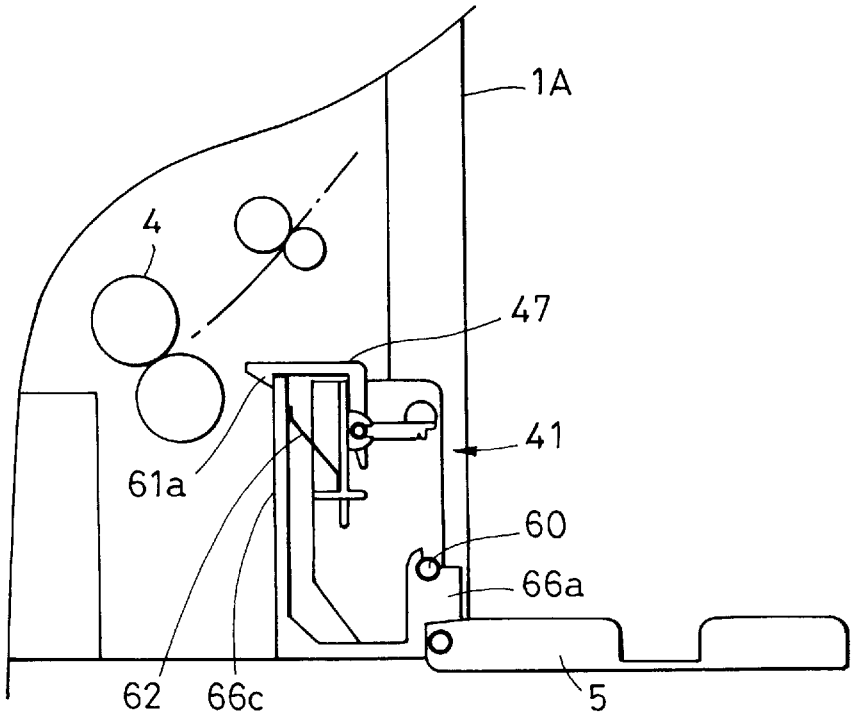

FIGS. 10A and 10B show a procedure for installing the LBP sheet conveyor unit 41. The interior of the main body 1A of LBP 1 becomes accessible when the door 5 has been opened as shown in FIG. 10A, so that the user can insert the LBP sheet conveyor unit 41 into main body 1A of LBP 1.

A pair of bearings 66*a* having substantially U-shaped grooves 66*b* are provided on the frame of the main body 1A of the LBP 1. Only one of these bearings 66*a* is shown in the drawings. The LBP sheet conveyor unit 41 is then mounted such that the mounting shafts 60 are received into the U-shaped grooves 66*b* which open upward, and is pivoted about the axis of the shafts 60 as indicated by the arrow in FIG. 10A, until a catch 61*a* formed on the free end of the lever 61 is retained on a fixed wall 66*c* which stands upright from the frame.

When the lever 61 is retained by the fixed wall 66*c*, the leaf spring 62 abuts against the fixed wall 66*c* so as to produce a force which acts to urge the whole LBP sheet conveyor unit 41 clockwise, whereby the LBP sheet conveyor unit 41 is firmly fixed by the engagement between the catch 61*a* of the lever 61 and the fixed wall 66*c*.

A description will now be given of a different example of the deck sheet conveyor unit 31 incorporated in the sheet deck 13.

Figure 11:
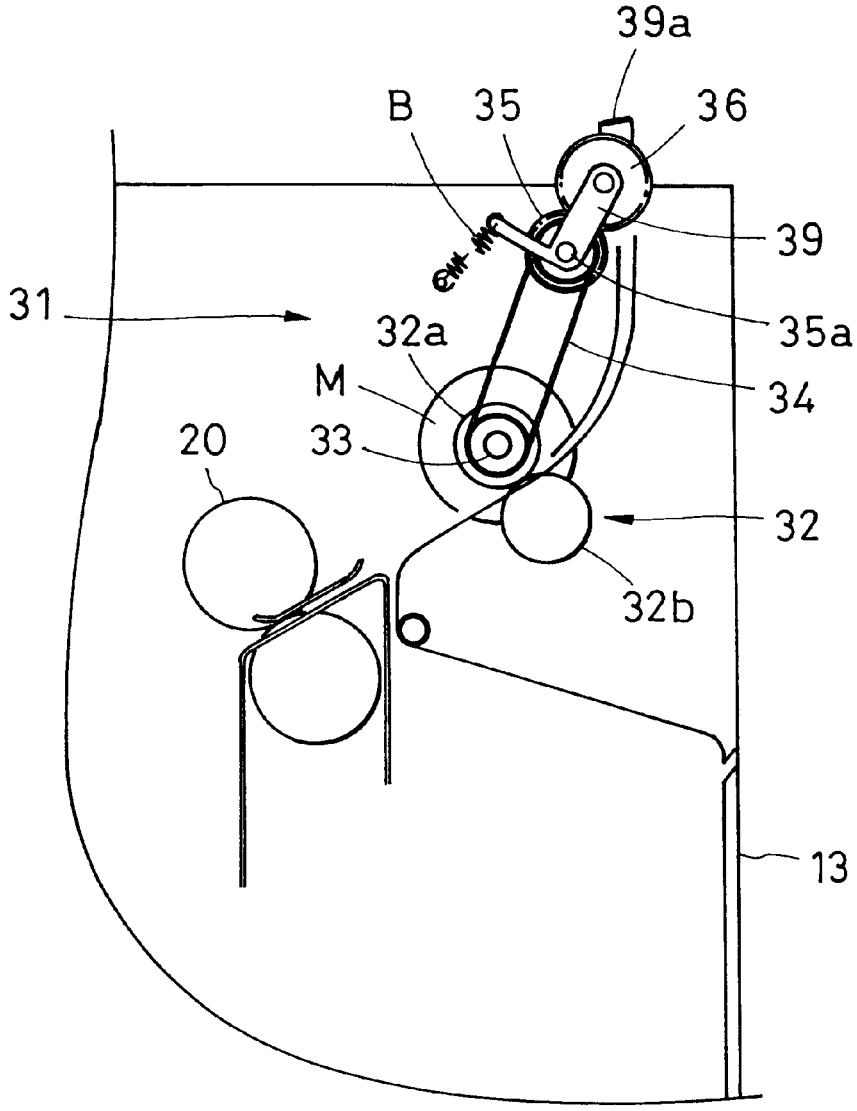
FIG. 11 is an illustration of an alternative example of the deck sheet conveyor unit on a sheet deck which is to be connected to the LBP.

FIG. 11 illustrates the structure of this example of the deck sheet conveyor unit 31. The deck sheet conveyor unit 31 has the following components or parts: a conveyor roller pair 32 including a power-driven conveyor roller 32*a* and an idler roller 32*b*; a motor M for driving a drive shaft 33 of the conveyor roller 32*a*; a drive gear 35 connected to the drive shaft 33 through a timing belt so as to be driven by the motor M, the drive gear 35 having a rotary shaft 35*a* rotatably supported on the main part 13A of the sheet deck 13; an L-shaped stay 39 pivotable about an axis provided by the rotary shaft 35*a*; and a rocker gear 36 provided on one end of the stay 39 and is held in engagement with the drive gear 35 so as to serve as a power transmission gear 36.

The timing belt 34, stay 39, drive gear 35 and the rocker gear 36 in cooperation provide driving power transmission means which transmits driving power to the LBP sheet conveyor unit 41, more specifically to the coupling gear 43, from the motor M which is the driving power source.

The stay 39 is urged counterclockwise by a tension spring which is retained at its one end by the free end of the stay 39. This counterclockwise motion is stopped by a stopper which is not shown. In this state, the rocker gear 36 partly projects above the upper end of the main part 13A of the sheet deck 13.

Figure 12:
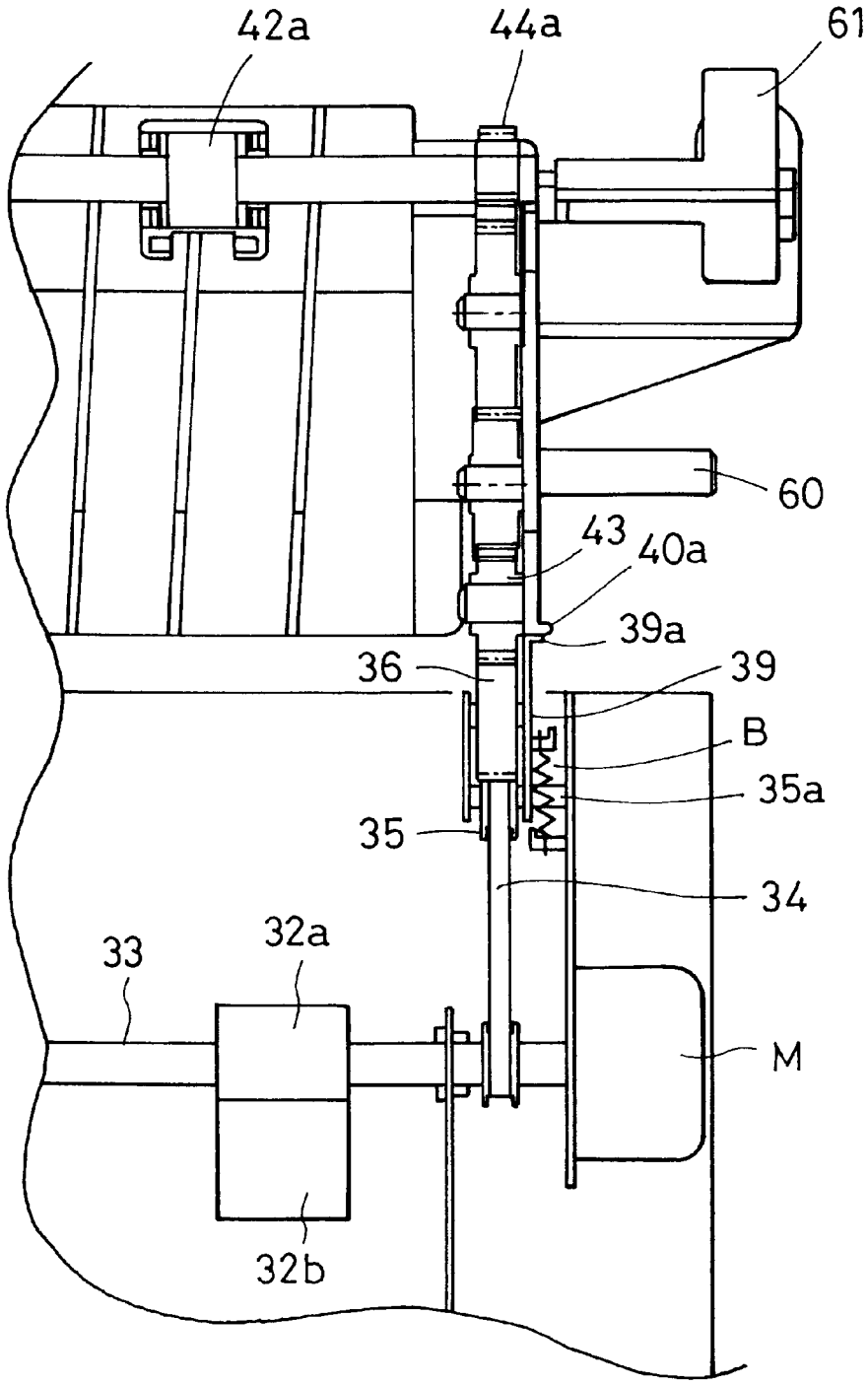
FIG. 12 is a front elevational view of a critical portion of the image forming apparatus, showing the sheet deck connected to the LBP.
Figure 13:
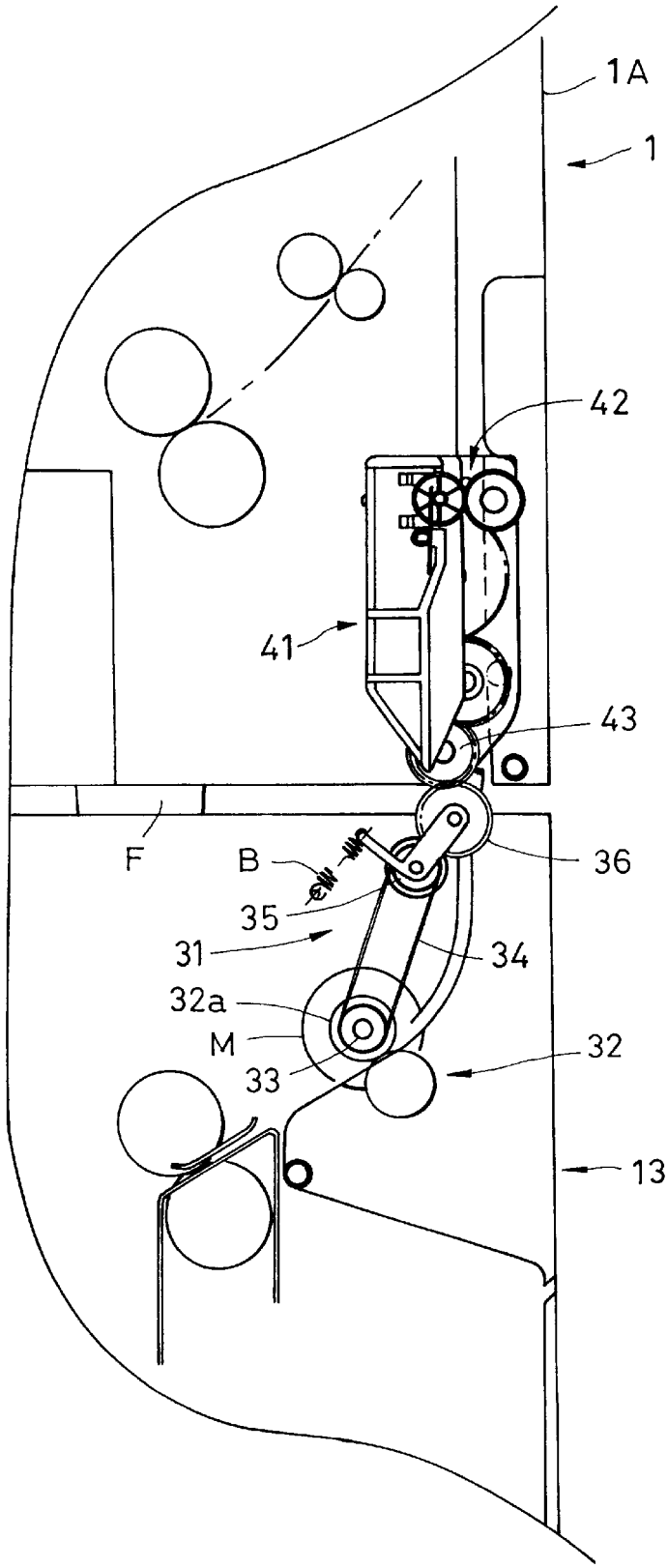
FIG. 13 is a side elevational view of the critical portion of the image forming apparatus, showing the sheet deck connected to the LBP.

Referring now to FIG. 12, the stay 39 is provided with a locating member 39*a* adapted to abut the locating member 40*a* of the LBP sheet conveyor unit 41 when the sheet deck is installed under the LBP 1.

The deck sheet conveyor unit 31 having the described construction is coupled with the LBP sheet conveyor unit 41 in the LBP 1 as follows. As the LBP 1 is lowered toward the sheet deck 13, the locating member 40*a* in the LBP sheet conveyor unit 41 is brought into contact with the locating member 39*a* on the stay 39 of the deck sheet conveyor unit 31 as shown in FIG. 12, whereby the stay 39 is swung downward against the force of the tension spring B.

Then, the LBP 1 is completely seated on the sheet deck 13 with the rubber feet F slightly compressed. In this state, the rocker gear 36 of the deck sheet conveyor unit 31 and the coupling gear 43 of the LBP sheet conveyor unit 41 mesh with each other.

When image forming instruction is given to the LBP 1, the control means operates to activate the motor M. The motor M drives the conveyor roller pair 32 of the deck sheet conveyor unit 31, whereby a sheet S is conveyed towards the LBP 1.

The power of the motor M is transmitted to the rocker gear 36 through the drive shaft 33 of the conveyor roller 32*a* and the timing belt 34 and the drive gear 35. The power is further transmitted from the rocker gear to the conveyor roller 42*a*, via the coupling gear 43 and the gear train 44*a*, 44*b*, 44*c*, whereby the conveyor roller 42*a* is rotated clockwise. The clockwise rotation of the conveyor roller 42*a* causes the sheet S supplied from the sheet deck 13 to be conveyed towards the image forming section of the LBP 1.

Figure 14:
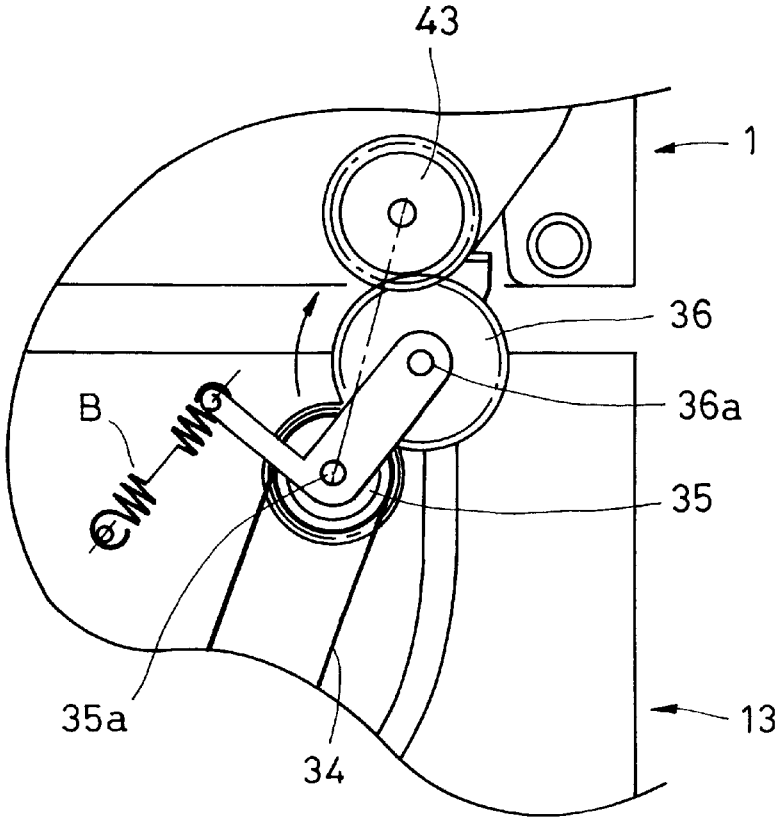
FIG. 14 is an enlarged side elevational view of the critical portion of the image forming apparatus, showing the sheet deck connected to the LBP.

As shown in FIG. 14, the axis of the drive shaft 36*a* of the rocker gear 36 is offset to the right from the straight line which interconnects the centers of the coupling gear 43 and the drive gear 35, when the rocker gear 36 is held in engagement with the coupling gear 43. This positional relationship of the three gears 35, 36 and 43 serves to produce a force which tends to reduce the distance between the axes of the coupling gear 43 and the drive gear 35 when the rocker gear 36 rotates clockwise as indicated by the arrow.

This force acts to maintain engagement between the rocker gear 36 on the deck sheet conveyor unit 31 and the coupling gear 43 on the LBP sheet conveyor unit 41, so that the driving power is transmitted from the deck sheet conveyor unit 31 to the LBP sheet conveyor unit 41 without fail. Actually, the distance between the axes of the coupling gear 43 and the drive gear 35 is maintained constant, by the effect of the locating means 39*a*, 40*a*.

This example of LBP sheet conveyor unit 41, as is the case of the preceding embodiment, is detachably mounted in the main body 1A of the LBP 1, and is driven by the power which is derived from the deck sheet conveyor unit 31. Therefore, the LBP itself need not have any motor exclusive for driving the LBP sheet conveyor unit 41. It is therefore possible to offer an inexpensive LBP to potential users who do not wish to use the sheet deck.

In the embodiments described heretofore, the power for driving the conveyor roller pair 42 of the LBP sheet conveyor unit 41 is derived from the sheet deck. This however is not exclusive, and the image forming apparatus of the present invention may be arranged to drive the LBP sheet conveyor unit 41 by power from a motor inherently provided in the LBP 1, thus achieving a simplified structure, provided that the motor can produce a torque large enough to accommodate the load of the LBP sheet conveyor unit 41 or that the motor is arranged for selective sharing of its output torque.

A different embodiment of the present invention, which drives the LBP sheet conveyor unit 41 by power available in the LBP 1 itself, will be described with reference to FIGS. 15 and 16.

Figure 15:
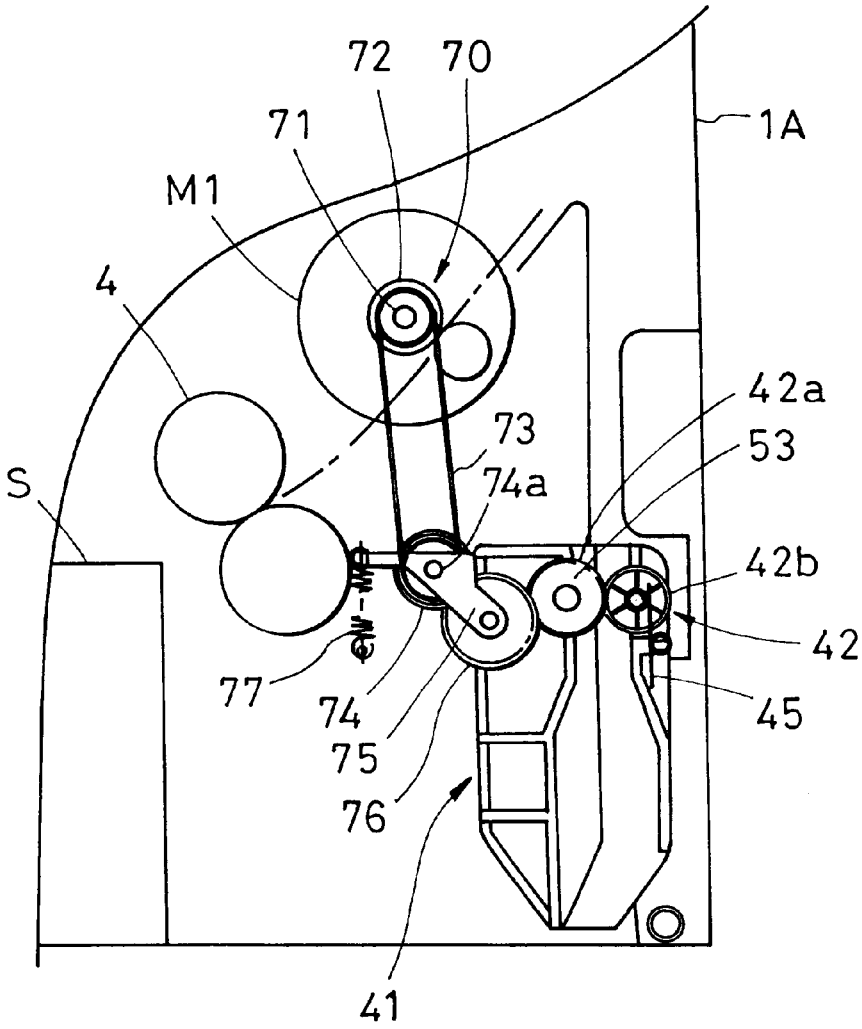
FIG. 15 is an illustration of another arrangement for transmitting driving power to the LBP sheet conveyor unit.

FIG. 15 is an enlarged view of a portion of this embodiment. In this Figure, the same reference numerals are used to denote the same or like parts or members as those in FIGS. 1 and 2. The structure for mounting the LBP sheet conveyor unit 41 may be the same as one of those described before.

Referring to FIG. 15, a coupling gear 53 as a driven gear is mounted on the drive shaft of the conveyor roller 42*a*. A conveyor roller pair 70, adapted to be driven by a motor M1, is disposed downstream of the retard roller pair 4 provided in the LBP 1. The motor M1 has a motor shaft 71 which carries a pulley 72. A timing belt 73 is stretched between the pulley 72 and a pulley provided for rotation together with a drive gear 74, so that the drive gear 74 is driven by the power from the motor M1. An L-shaped stay 75 is pivotable on a shaft 74*a* which carries the drive gear 74 and which is rotatably supported in the main body 1A of the LBP 1. The L-shaped stay 76 carries at its one end a rocker gear 76 which meshes with the drive gear 74 and which serves as a power transmission gear.

The timing belt 73, stay 75, drive gear 74 and the rocker gear 76 in cooperation form a driving power transmission means which transmits the power of the motor M1 as the driving power source to the LBP sheet conveyor unit 41, more specifically to the coupling gear 53.

The stay 75 is urged counterclockwise by a tension spring 77 which is retained by the free end of the stay 75. Before the LBP sheet conveyor unit 41 is installed, this counterclockwise motion of the stay 75 is stopped as the stay 75 abuts a stopper which is not shown. In this state, the rocker gear 76 projects outward, as shown in FIG. 16. As will be seen from FIG. 16, the stay 75 has a locating member 75A which, when the LBP sheet conveyor unit 41 is installed in the LBP 1, abuts a side wall 54 of the LBP sheet conveyor unit 41.

The LBP sheet conveyor unit 41 is installed in the LBP 1 in the following procedure. The interior of the LBP 1 becomes accessible as the door 5 of the LBP 1 is opened, so that the user can move the LBP sheet conveyor unit 41 into the main body 1A of the LBP 1. Then, the LBP sheet conveyor unit 41 is mounted in the LBP main body 1A in the same way as that described before. When the LBP sheet conveyor unit 41 is mounted, the locating member 75*a* on the stay 75 abuts the side wall 54 of the LBP sheet conveyor unit 41, so that the coupling gear 53 engages with the rocker gear 76 while preserving a proper distance between the axes of the coupling gear 53 and the drive gear 74.

When image forming instruction is given to the LBP 1, a control means (not shown) provided in the LBP 1 operates to activate the motor M1. The output power of the motor M1 is transmitted via the timing belt 73 and the drive gear 74 to the rocker gear 76 and further to the coupling gear 53, whereby the conveyor roller 42*a* of the conveyor roller pair 42 is driven counterclockwise. Consequently, the sheet S is conveyed toward the image forming section.

Figure 16:
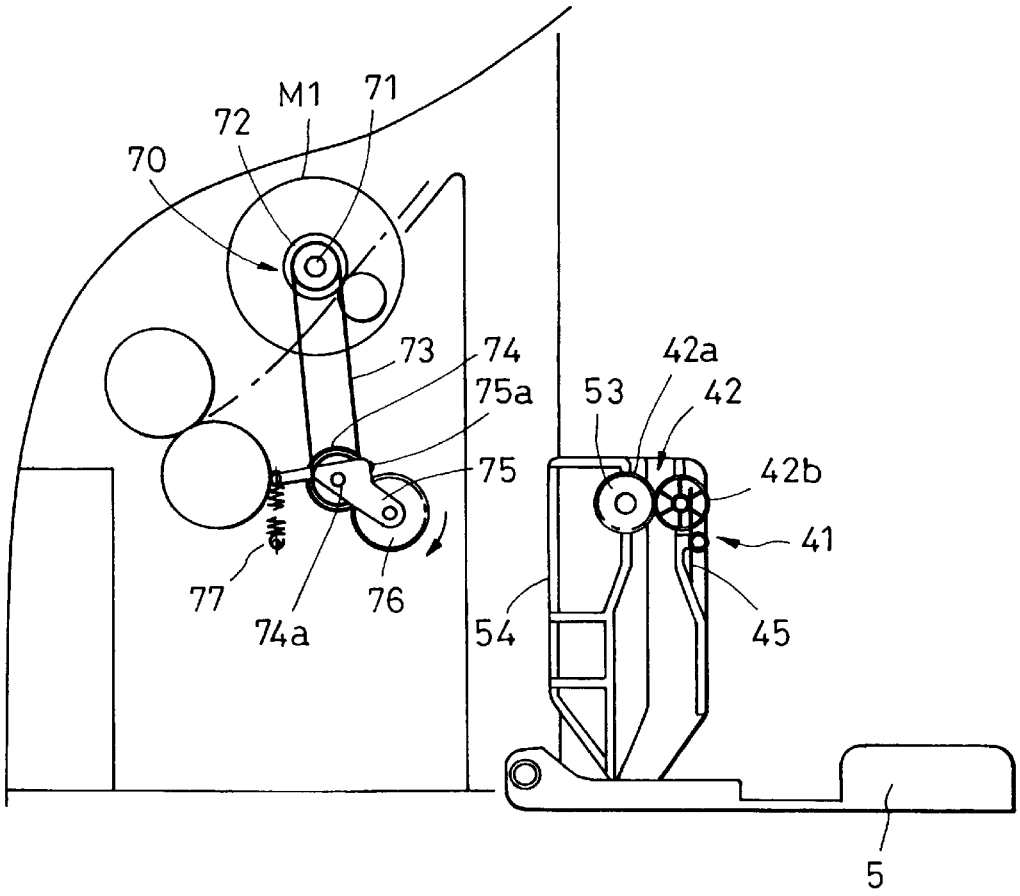
FIG. 16 is an illustration explanatory of the procedure for mounting the LBP sheet conveyor unit shown in FIG. 15.

Thus, the rocker gear 76 rotates clockwise as indicated by an arrow in FIG. 16. The rotation of the rocker gear 76 in this direction produces a force which acts on the coupling gear 53 tending to reduce the distance between the axes of the coupling gear 53 and the drive gear 74. This serves to maintain a proper state of engagement between the rocker gear 76 and the coupling gear 53 of the LBP sheet conveyor unit 41, whereby the power from the motor M1 is transmitted to the LBP sheet conveyor unit 41 without fail.

In this embodiment, the LBP sheet conveyor unit 41 is demountably installed in the main body 1A of the LBP 1, and is driven by power derived from the motor M1 which is mounted in the main body 1A of the LBP 1 and which is intended to drive other components in the LBP main body 1A. It is therefore possible to simplify the structure of the driving means for driving the LBP sheet conveyor unit 41, thus offering a reduction in the cost of production of the LBP 1. Preferably, the conveyor roller pair 42 is disposed close to the motor M1 so that the number of intermediary gears can be reduced and the torque transmission efficiency is improved.

In the embodiment described with reference to FIGS. 15 and 16, the LBP sheet conveyor unit 41 is driven by the motor M1 already provided in the LBP 1. This arrangement may be modified such that the power of the motor M1 in the LBP 1 is used also to drive the deck sheet conveyor unit 31 in the sheet deck, provided that the capacity of the motor is large enough to drive the deck sheet conveyor unit 31 in addition to the LBP sheet conveyor unit 41. Such a modification further simplifies the overall structure, as will be understood from the following description.

Figure 17:
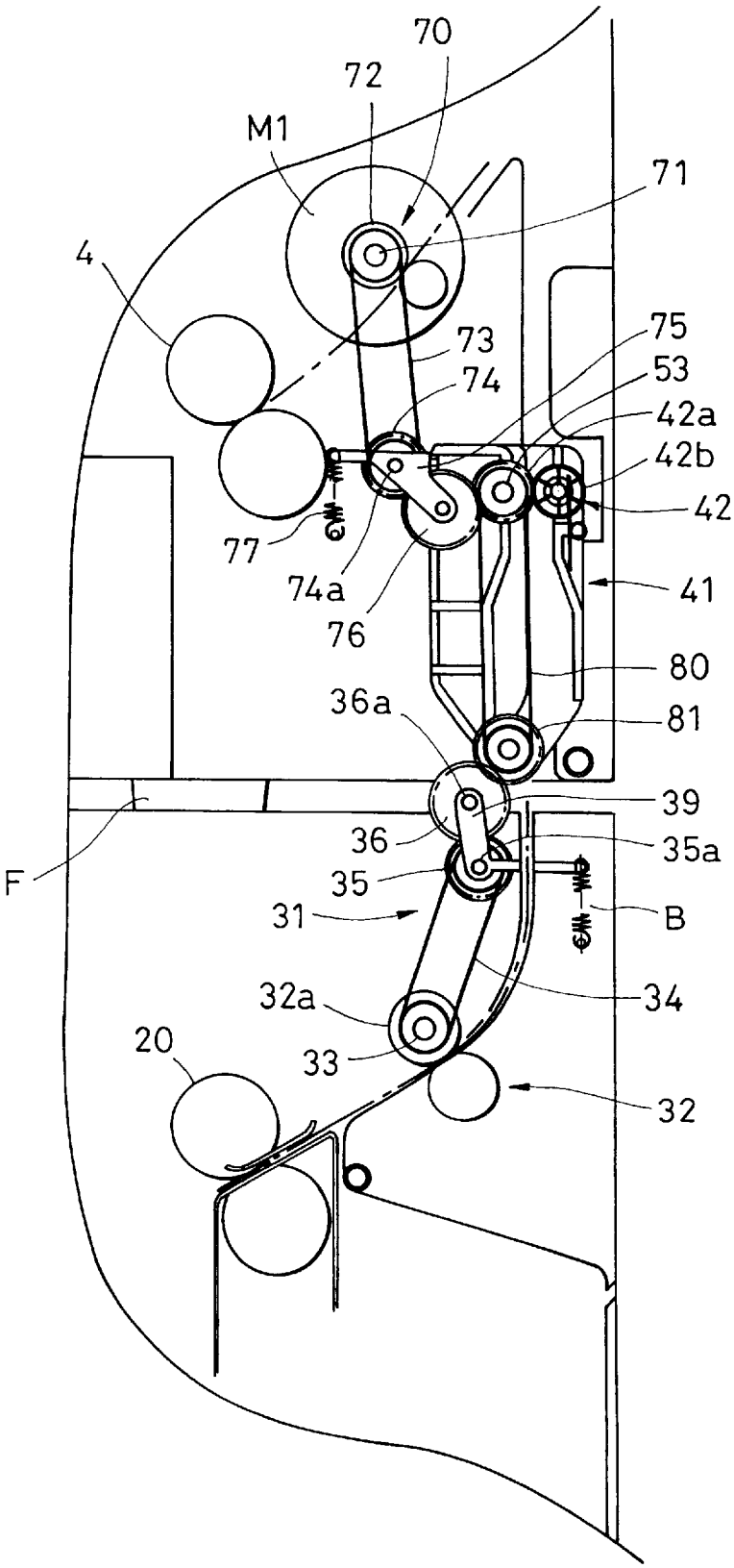
FIG. 17 is an illustration of still another arrangement for transmitting driving power to the LBP sheet conveyor unit.
Figure 18:
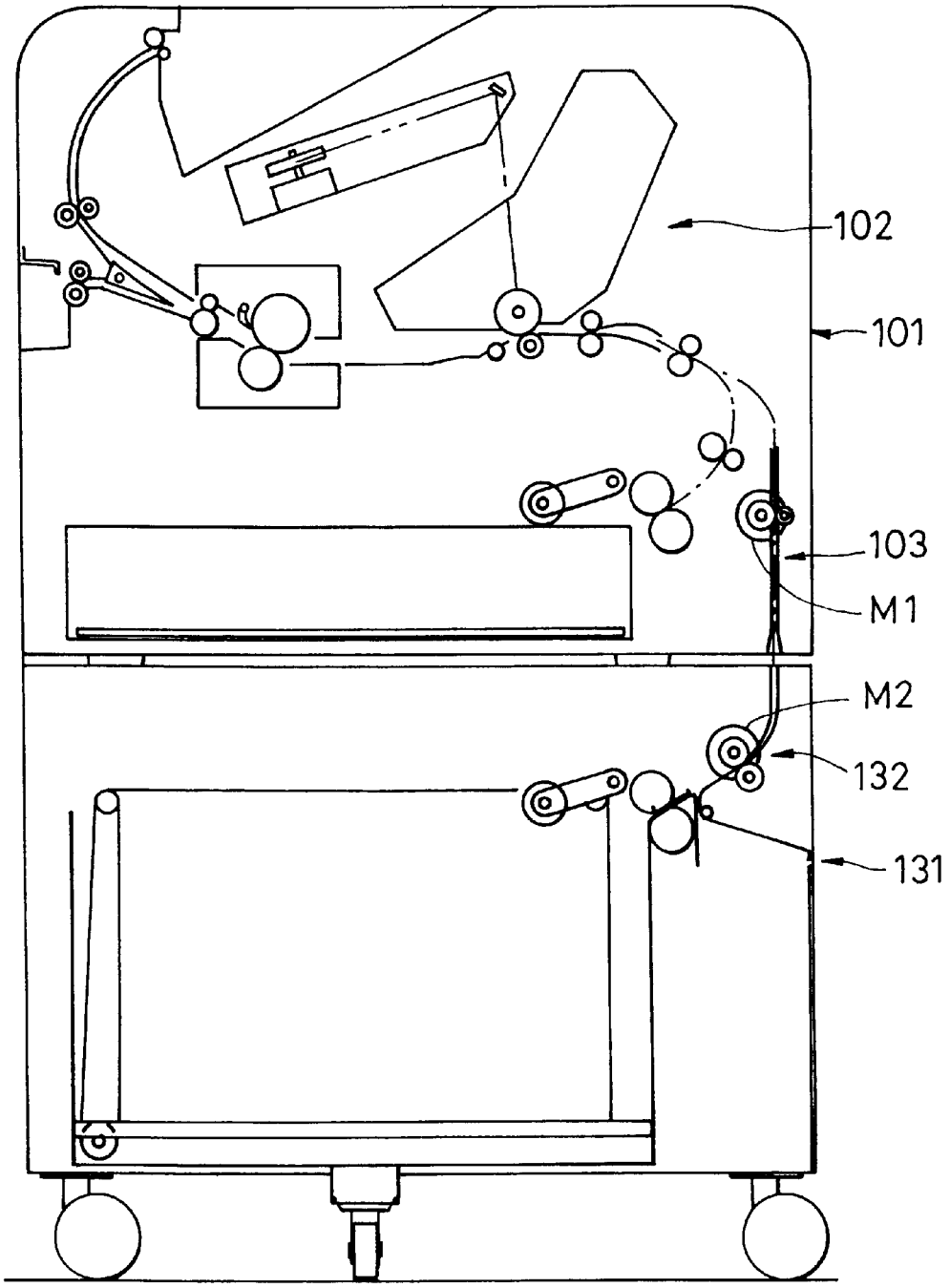
FIG. 18 PRIOR ART
FIG. 18 is an illustration of a conventional image forming apparatus.

FIG. 17 is an enlarged view of the modification. In this Figure, the same reference numerals are used to denote the same or like parts as those in FIGS. 11 thru 15, and detailed description of such parts is omitted. It will be seen that this modification is devoid of the motor M which is used in the embodiment shown in FIG. 11.

Referring to FIG. 17, the LBP sheet conveyor unit 41 of this modification has an extension transmission means for transmitting the power of the motor M1 further to the deck sheet conveyor unit 31. The extension transmission means has a coupling gear 53 which serves also as a drive gear, a timing belt 80, and another coupling gear 81 which serves as a driving power transmission gear and which has a pulley portion drivingly connected to the coupling gear 53 through the timing belt 80. Thus, the coupling gear 81 is driven by the power from the motor M1 via the coupling gear 53 and the timing belt 80. The procedure of mounting this LBP sheet conveyor unit 41 in the main body 1A of the LBP 1 is not described here because the LBP sheet conveyor unit 41 can be installed in the same way as that described before.

After the sheet deck 13 is coupled to the LBP 1 to bring the rocker gear 36 into engagement with the coupling gear 81, a control (not shown) in the LBP 1 operates to activate the motor M1. The output power of the motor M1 is transmitted through the timing belt 73 and the drive gear 74 to the rocker gear 76 and further transmitted therefrom to the coupling gear 53, whereby the conveyor roller 42*a* rotates clockwise.

Part of the torque received by the coupling gear 53 from the motor M1 is transmitted to the rocker gear 36 of the deck sheet conveyor unit 31 via the timing belt 81 and the coupling gear 61, and is transmitted further to the conveyor roller 32*a* through the transmission gear 35 and the timing belt 34, whereby the conveyor roller 32*a* is driven to rotate in the sheet feeding direction (counterclockwise as viewed in FIG. 17).

As a result of the rotation of the conveyor roller 32*a* in the sheet feeding direction, the sheet S is advanced into the LBP 1 and is forwarded to the image forming section by means of the LBP sheet conveyor unit 41, more specifically by the conveyor roller 41*a* which is rotating counterclockwise as heretofore explained.

The arrangement is such that, when the rocker gear of the deck sheet conveyor unit 31 and the coupling gear 81 of the LBP sheet conveyor unit 41 are held in engagement with each other, the axis of the shaft 36*a* carrying the rocker gear 36 is offset to the left from the straight line that interconnects the axes of the coupling gear 81 and the transmission gear 35. This positional relationship of the three gears 35, 36 and 81, when the rocker gear 36 rotates clockwise, causes the rocker gear 36 to produce a force which tends to reduce the distance between the axes of the coupling gear 81 and the transmission gear 35.

This serves to maintain a proper engagement between the rocker gear 36 of the deck sheet conveyor unit 31 and the coupling gear 81 of the LBP sheet conveyor unit 41, so that the power from the motor in the LBP 1 is transmitted to the deck sheet conveyor unit 31 without fail.

In the described modification, the LBP sheet conveyor unit 41 is demountably installed in the main body 1A of the LBP and is actuated by power derived from a source, i.e., the motor M1, provided in the LBP. If a potential user does not wish to use the sheet deck 13, the LBP sheet conveyor unit 41 is not installed. It is therefore possible to offer inexpensive LBPs for potential users who do not wish to use the sheet deck 13. In addition, the cost of the sheet deck 13 can be reduced because the power of the driving source, i.e., the motor M1, in the LBP can effectively used also for driving the deck sheet conveyor unit 31.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus comprising:

a main body having an image forming section;

a sheet supply means connectable to said main body, for feeding sheets into said main body;

a sheet conveyor unit demountably mounted in said main body, for receiving, when said sheet supply means is connected to said main body, a sheet fed from said sheet supply means and for conveying said sheet toward said image forming section;

a driving power source provided in said sheet supply means; and driving power transmission means for transmitting driving power from said driving power source in said sheet supply means to said sheet conveyor unit mounted in said main body.

2. An image forming apparatus according to claim 1, wherein said driving power transmission means includes a drive gear driven by the power of said driving power source, a driving transmission gear for meshing with said drive gear, and a driven transmission gear to drive said sheet conveyor unit, and wherein, when said sheet supply means is connected to said main body, said driving transmission gear is brought into engagement with said driven transmission gear so as to be able to drive said sheet conveyor unit.

3. An image forming apparatus according to claim 2, wherein said driving power transmission means is arranged such that said driving transmission gear rotates clockwise when an axis of said driving transmission gear is on the right side of a line that interconnects axes of said drive gear and said driven transmission gear, and counterclockwise when the axis of said driving transmission gear is on the left side of said line.

4. An image forming apparatus according to claim 1, wherein when said main body is placed on said sheet supply means said sheet conveyor unit conveys the sheet substantially vertically upward, upon receipt of sheet from said sheet supply means.

5. An image forming apparatus comprising:

a main body having an image forming section;

a sheet supply means connectable to said main body, for feeding sheets into said main body;

a sheet conveyor unit demountably mounted in said main body, for receiving, when said sheet supply means is connected to said main body, a sheet fed from said sheet supply means and for conveying said sheet toward said image forming section;

a driving power source mounted in said main body; and driving power transmission means for transmitting power from said driving power source to said sheet conveyor unit mounted in said main body.

6. An image forming apparatus according to claim 5, wherein said driving power transmission means includes a drive gear driven by the power of said driving power source, a driving transmission gear meshing with said drive gear, and a driven transmission gear to drive said sheet conveyor unit, and wherein, when said sheet conveyor unit is mounted in said main body, said driving transmission gear is brought into engagement with said driven transmission gear so as to be able to drive said sheet conveyor unit.

7. An image forming apparatus according to claim 6, further comprising:

a sheet conveyor means provided in said sheet supply means, for conveying the sheets from said sheet supply means into said main body; and extension driving power transmission means for transmitting the power derived from said driving power source to said sheet conveyor means.

8. An image forming apparatus according to claim 7, wherein said extension driving power transmission means comprises a drive gear driven to rotate by the driving power transmitted through said driving power transmission means from said driving power source, a driving power transmission gear driven by said drive gear, a driven power transmission gear and a transmission gear meshing with said driven power transmission gear, and wherein, when said sheet supply means is connected to said main body, said driving power transmission gear is brought into engagement with said driven transmission gear, thereby to drive said sheet conveyor means.

9. An image forming apparatus according to claim 8, wherein said driving power transmission means is arranged such that said driving power transmission gear rotates clockwise when an axis of said driving power transmission gear is on the right side of a line that interconnects axes of said drive gear and said driven power transmission gear, and counterclockwise when the axis of said driving power transmission gear is on the left side of said line.

10. An image forming apparatus according to claim 8, wherein said extension driving power transmission means is arranged such that said driven power transmission gear rotates clockwise when an axis of said driven power transmission gear is located on the right side of a line that interconnects axes of said driving power transmission gear and said transmission gear meshing with said driven power transmission gear, and counterclockwise when the axis of said driven power transmission gear is on the left side of said line.

11. An image forming apparatus comprising:

a main body having an image forming section;

a sheet supply means connectable to said main body, for feeding sheets into said main body;

a sheet conveyor unit demountably mounted in said main body, for receiving, when said sheet supply means is connected to said main body, a sheet fed from said sheet supply means and for conveying said sheet toward said image forming section; and detecting means for detecting a mounting state of said sheet conveyor unit in said image forming apparatus.

12. An image forming apparatus according to claim 11, wherein said detecting means detects that said sheet conveyor unit has been mounted in said image forming apparatus, when said sheet supply means is connected to said main body.

13. An image forming apparatus according to claim 11, wherein said detecting means comprises a sensor that is provided in said main body of said image forming apparatus and that is adapted to sense the state of mounting of said sheet conveyor unit.

14. An image forming apparatus according to claim 13, wherein said detecting means detects that a sheet is stationary in said image forming apparatus and the state of mounting of said sheet conveyor unit, the detection of the state of mounting of said sheet conveyor unit being determined based on the stationary condition of a sheet in said image forming apparatus.

15. An image forming apparatus according to claim 11, wherein said detecting means comprises a sensor that is provided in said sheet supply means and that is adapted to sense the state of mounting of said sheet conveyor unit.

16. An image forming apparatus according to claim 15, wherein said detecting means determines that said sheet conveyor unit has not been mounted in the main body of said image forming apparatus when said detecting means detects that the sheet on a conveyance path remains stationary for a predetermined length of time.

17. A sheet conveyor unit for guiding a sheet to an image forming section of an image forming apparatus, said sheet being received from an optional sheet supply means connected to said image forming apparatus, said sheet conveyor unit comprising:

a frame mountable in said image forming apparatus, said frame, when mounted, providing a vertical conveyor path along which the sheet received from the optional sheet supply means is fed upward;

conveyor means provided on said frame for conveying the sheet received from the optional sheet supply means;

a guide provided on said frame, for guiding the sheet received from the optional sheet supply means; and a gear train adapted to receive and transmit a driving power from a driving source provided in said optional sheet supply means to said conveyor means.

18. A sheet conveyor unit according to claim 17, further comprising positioning means provided on said frame, for positioning said sheet conveyor unit in relation to said image forming apparatus when said sheet conveyor unit is mounted in said image forming apparatus.

19. A sheet conveyor unit according to claim 18, wherein said positioning means comprises a positioning shaft adapted to be received in a positioning hole provided in said image forming apparatus.

* * * * *

UNITED STATES PATENT AND TRADEMARK OFFICE

CERTIFICATE OF CORRECTION

PATENT NO. : 6,643,480 B2
DATED : November 4, 2003
INVENTOR(S) : Takashi Kuwata et al.

It is certified that error appears in the above-identified patent and that said Letters Patent is hereby corrected as shown below:

Column 4,
Line 6, “us” should read -- is --.

Column 6,
Line 9, “arrow a” should read -- arrow α --.
Line 67, “50 s” should read -- 50 is --.

Signed and Sealed this

First Day of June, 2004

JON W. DUDAS
*Acting Director of the United States Patent and Trademark Office*